US010143885B2

(12) United States Patent
DuMee

(10) Patent No.: US 10,143,885 B2
(45) Date of Patent: Dec. 4, 2018

(54) PORTABLE EXERCISE DEVICE FOR RESISTANCE EXERCISES

(71) Applicant: William James DuMee, Longwood, FL (US)

(72) Inventor: William James DuMee, Longwood, FL (US)

( * ) Notice: Subject to any disclaimer, the term of this patent is extended or adjusted under 35 U.S.C. 154(b) by 214 days.

(21) Appl. No.: 15/068,963

(22) Filed: Mar. 14, 2016

(65) Prior Publication Data

US 2016/0263420 A1 Sep. 15, 2016

Related U.S. Application Data

(60) Provisional application No. 62/132,540, filed on Mar. 13, 2015.

(51) Int. Cl.
*A63B 23/12* (2006.01)
*A63B 21/055* (2006.01)
(Continued)

(52) U.S. Cl.
CPC ..... *A63B 23/12* (2013.01); *A63B 21/0442* (2013.01); *A63B 21/0552* (2013.01); *A63B 21/4034* (2015.10); *A63B 21/4035* (2015.10); *A63B 21/4043* (2015.10); *A63B 23/0355* (2013.01); *A63B 23/03508* (2013.01); *A63B 23/03541* (2013.01); *A63B 23/1209* (2013.01); *A63B 21/00065* (2013.01); *A63B 21/00069* (2013.01); *A63B 21/0557* (2013.01); *A63B 21/169* (2015.10); *A63B 21/1609* (2015.10); *A63B 21/1672* (2015.10); *A63B 23/0211* (2013.01); *A63B 23/0233* (2013.01); *A63B 23/03525* (2013.01); *A63B 23/03575* (2013.01); *A63B 23/047* (2013.01); *A63B 23/1245* (2013.01); *A63B 23/14* (2013.01); *A63B 2023/006* (2013.01); *A63B 2023/0411* (2013.01); *A63B 2071/0018* (2013.01); *A63B 2071/027* (2013.01);
(Continued)

(58) Field of Classification Search
CPC ..... A63B 21/1609; A63B 21/0442; A63B 2208/0233; A47C 9/002; Y10S 482/904
See application file for complete search history.

(56) References Cited

U.S. PATENT DOCUMENTS 5,792,034 A * 8/1998 Kozlovsky ..... A63B 21/0004 482/124
6,099,445 A * 8/2000 Rovinsky ..... A63B 21/0552 482/121
(Continued)

*Primary Examiner* — Joshua T Kennedy

(57) ABSTRACT

A portable exercise device comprising of a base with a plurality of apertures and at least one resistance member threaded through the apertures and with both ends of the resistance member available for gripping by the user during performance of resistance exercises. A device that is flexible, comfortable, light weight and with ease of use provides multiple strengthening, stretching or physical therapy resistance exercises for the chest, shoulders, back, arms, abdominal and leg muscles. The exercise device can be used at home, the office or in a hotel room and unattached on any couch, chair, bed, wheel chair or vehicle seat. With the portable exercise device of the present invention the user can get an upper body, abdominal or leg workout in a minimal amount of time.

16 Claims, 32 Drawing Sheets

(51) Int. Cl.

| | |
|---|---|
| ***A63B 21/00*** | (2006.01) |
| ***A63B 21/04*** | (2006.01) |
| ***A63B 23/035*** | (2006.01) |
| *A63B 23/02* | (2006.01) |
| *A63B 23/04* | (2006.01) |
| *A63B 23/14* | (2006.01) |
| *A63B 23/00* | (2006.01) |
| *A63B 71/00* | (2006.01) |
| *A63B 21/16* | (2006.01) |
| *A63B 71/02* | (2006.01) |

(52) U.S. Cl.
CPC ..... *A63B 2208/0204* (2013.01); *A63B 2208/0233* (2013.01); *A63B 2208/0252* (2013.01); *A63B 2209/00* (2013.01); *A63B 2210/50* (2013.01)

(56) References Cited

U.S. PATENT DOCUMENTS 6,117,056 A * 9/2000 Cataldi, Jr. ..... A63B 21/0552 482/121
6,500,104 B1 * 12/2002 Rich ..... A63B 21/04 482/123
6,544,152 B2 * 4/2003 Rosati ..... A63B 21/055 482/126
7,137,935 B2 * 11/2006 Clarke ..... A63B 21/00043 482/123
7,322,907 B2 * 1/2008 Bowser ..... A63B 21/04 482/121
7,524,271 B2 * 4/2009 Bendavid ..... A63B 21/0552 297/217.1
7,775,949 B2 * 8/2010 Bowser ..... A63B 21/00043 482/121
7,803,094 B1 * 9/2010 Bolick, Jr. ..... A63B 21/0552 482/102
8,162,809 B1 * 4/2012 Eastwood ..... A63B 21/0552 482/123
8,876,676 B2 * 11/2014 Lalaoua ..... A63B 71/023 482/123
9,079,062 B2 * 7/2015 Thomas ..... A63B 21/4025
2002/0160892 A1 * 10/2002 Rovinsky ..... A63B 21/04 482/148
2005/0159276 A1 * 7/2005 Falcone ..... A63B 21/04 482/123
2006/0052224 A1 * 3/2006 Kellogg ..... A63B 21/0552 482/130
2006/0194679 A1 * 8/2006 Hatcher ..... A63B 21/04 482/123
2008/0004166 A1 * 1/2008 Oren ..... A63B 21/0004 482/142
2008/0139369 A1 * 6/2008 Vigilia ..... A63B 21/0004 482/124
2008/0203776 A1 * 8/2008 Mongelluzzo ..... A47C 9/002 297/118
2009/0163336 A1 * 6/2009 Mueller ..... A47C 31/11 482/129
2010/0016134 A1 * 1/2010 Reese ..... A63B 21/00047 482/131
2011/0183819 A1 * 7/2011 Pharoe ..... A63B 21/0552 482/105
2013/0157824 A1 * 6/2013 Chen ..... A63B 21/0442 482/142

* cited by examiner

FIG. 28A
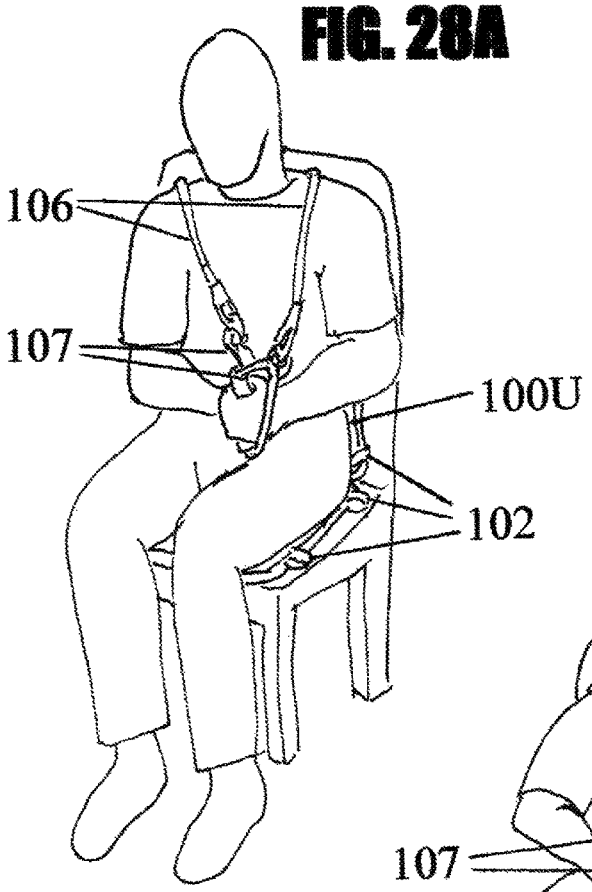
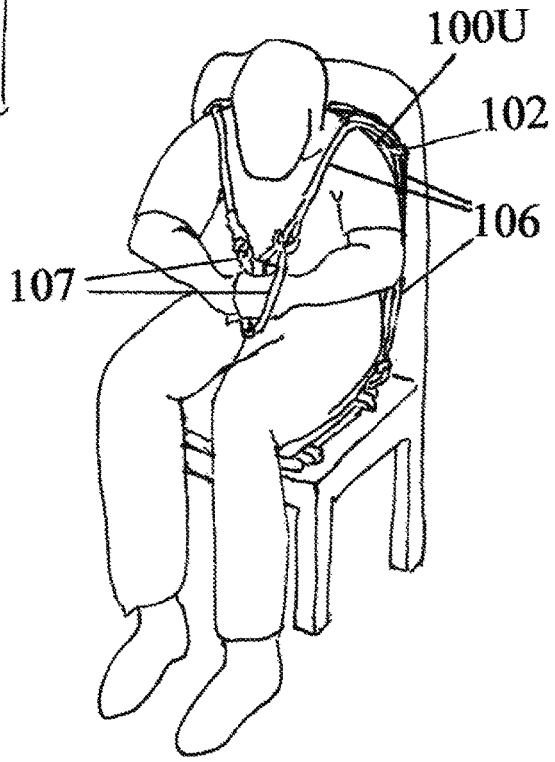
FIG. 28B

PORTABLE EXERCISE DEVICE FOR RESISTANCE EXERCISES

This application claims the benefit of Provisional Patent Application 62/132,540 Filed Mar. 13, 2015

BACKGROUND OF THE INVENTION

Individuals often desire to get in better shape, improve their general fitness and muscle tone but often fail to start or continue an exercise routine for a significant period of time. People of all ages want to get rid of flabby arms, reduce their stomach size, lose weight, replace fat tissue with muscle or increase muscle size.

A desire for fitness improvement and the common failure to successfully do something about it is not new and has frustrated and discouraged millions year after year. Many surveys state the number one reason people don't exercise regularly is time followed closely by convenience.

Some people cannot afford a fitness membership or are too embarrassed to workout in front of other people. Many often join a fitness center, however do not have the time or are too inconvenienced to regularly change, drive to the fitness center, workout on multiple machines, shower and return home.

The working person also often does not have time or is too inconvenienced to change clothes, drive to the fitness center, workout and shower and then return to work during their allotted lunch or break time or even to do so after work.

Travelers, either for business or pleasure, staying at a hotel after a long demanding day away from home, often fail to find time to go to the hotel exercise room for a workout as planned.

Even if individuals who have bought an exercise device for the home, by the time they get home, they are usually either too tired or distracted by the TV, family or other needs often fail to stay on a disciplined fitness schedule.

Also individuals confined to a bed, wheel chair or other seated assistance device are extremely limited in finding an affordable, functional and comfortable exercise device to perform needed strengthening, stretching or physical therapy exercises while sitting or lying down.

Many of standard exercise equipment products today are prohibitively large, heavy, cumbersome, not portable and too expensive for home and office work space use.

The portable exercise devices currently existing on the market are not designed or flexible enough to use with a variety of chairs, couches, beds or on the floor. The current portable exercise devices also do not have the functionality to be used for seated, lying and standing exercises.

There are many elastic resistance tubes or bands are on the market today, but the exercises with them are designed for placing the tube or band under the persons foot, attaching to a door or to be used in a standing or kneeling position, not comfortably on a sitting or lying means.

The prior art includes some devices for chairs but many require the device's body to be attached to the chairs limiting the portability and the types of chairs they can be used on.

Much of the prior art for exercise devices include many numerous and/or complex parts, often of a mechanical nature, that limit the ability of manufacturing and selling the inventions at an affordable price The portable devices of the prior art also seem to not provide a range of exercise options or do not allow for upper body, abdominal and leg exercises.

U.S. Pat. No. 8,162,809 to Eastwood (2012) describes a portable exercise device with resistance members. The device has primarily a seat base member only and therefore is limited in the exercise options (e.g. chest press, abdominal crunches, leg squats). Also the device does not provide the option for standing or leg exercises.

U.S. Pat. No. 5,860,897 to Gilbert and Dewsnap (1999) describes a relatively rigid molded thermoplastic sheet seat member, which is also limited in terms of the variety of exercises that can be performed with the device and is limited to certain types of sitting arrangements. Also the device does not provide the option for standing or leg exercises.

U.S. Pat. No. 6,500,104 to Rich (2002) describes a device requiring a rigid frame, designed for attachment to vehicle seat. The device is limited to certain types of sitting arrangements, is not intentioned for use with lying means and would require specific manufacturing of the rigid frame and special base member/cushion(s). Also the device does not provide the option for standing or leg exercises.

U.S. Pat. No. 6,117,056 to Cataldi and Hagen (2000) describes a seat cushion that must be strapped around a chair. A seat cushion is provided, and D-rings are included generally on the strap portion for attachment of elastic members. This device is limited to certain types of sitting arrangements and variety of exercises that can be performed (i.e. not chest press or abdomen exercises). Also the device does not provide the option for standing or leg exercises.

U.S. Pat. No. 7,381,168 to Bowser (2008) describes an exercise device with a support structure, chair, anchor modules and special resistance cables. This device has many rigid and specialized parts which would require specific manufacturing and is not portable.

U.S. Pat. No. 7,137,935 to Clarke and Wilson-Clarke (2004) describes an exercise kit witch attaches to an office chair. This device is limited to certain types of sitting arrangements.

U.S. Pat. No. 6,099,445 to Rovinsky and Zborovsky (1998) describes an exercise device with a rigid frame and is mountable on a column of a chair. This device has many rigid and specialized parts which would require specific and expensive manufacturing, is very limited to specific seating means and is not portable.

SUMMARY

Therefore, a need exists for an exercise device that by its comfort, ease of use, convenience and the reduced time required for a workout using the exercise device, will encourage the user to exercise and continue an exercise routine.

This need requires a portable exercise device that can be used on any type chair (without attachment) as well as a couch, bed or the floor, that can be used while sitting, lying down and standing, and therefore can be used comfortably at home, the office or in a hotel room.

A portable exercise device that also conveniently provides multiple strengthening, stretching or physical therapy exercise options (e.g., chest, shoulders, back, arms, abdominal and leg exercises), and that the resistance or weight levels can be changed easily and can vary based on the needs of the user.

Further for the device to meet this need with minimal and simplistic parts that allow the device to be manufactured and sold at an affordable price.

To achieve the above and accordance with the purpose of the inventions embodied and broadly described herein, a portable exercise device is provided which comprises of a flexible supporting base with a plurality of inward or outward base apertures and at least one resistance member. The resistance member(s) to be threaded through base apertures at various locations, each resistance member(s) with two free ends, neither end nor any portion of each resistance member(s) fastened or anchored to said base.

The portable exercise device would be used with any sitting or lying means or in a standing position and enable the user to perform multiple resistance exercises or stretches involving the chest, shoulders, back, arms, abdomen and legs. Use with a sitting or lying means would include the user comfortably sitting on top of the device or lying on the device while the device is placed unattached on, but not limited to, a home or office chair, having back or no back, having cushioned or not cushioned, having arms or not arms; a stool; a bench; a sofa; a couch; a bed or any other structure designed for sitting or lying.

One or more aspects of the portable exercise device would include a base consisting of attached upper and lower base members, but in other aspects of the portable exercise device a single base member would be included.

The portable exercise device in one or more aspects would also include two sets of resistance members, an upper and a lower set, each set having at least one resistance member with two free ends having at each end a single gripping device.

The resistance members will have different resistance levels which will allow the user to easily adjust resistance levels for an exercise by attaching or detaching the desired resistance member(s) to the gripping device. Typically each set of resistance members will be threaded through the base apertures with two free ends available for attaching or detaching to the gripping device.

It is contemplated that in one or more aspects of the portable exercise device that a plurality of resistance members, instead of a single resistance member be used for the upper and lower set of resistance members.

Also contemplated in one or more aspects of the portable exercise device is that resistance members with permanently attached gripping devices to be used. The permanently attached gripping devices of the resistance member to also be threaded through base apertures when positioning the resistance members before starting an exercise.

It is further contemplated that of one or more aspects of the portable exercise device that resistance members without handles be used, simply the resistance members to be gripped by the user's hands while performing exercises.

Critical features of one or more aspects of the portable exercise device are:

1) New and not, found in the prior art; the use of strategically placed base apertures located outwardly of respective peripheral edges of the base, formed by connected strap loops, rings or hooks, that allow the resistance members to be threaded through the apertures, the resistance members having both ends free, neither end nor any portion of each resistance members fastened or anchored to said base.

The threaded and unattached resistance members would have a single gripping device at each end for gripping by the user. The prior art only describes resistance members that have one end attached to an exercise device or that have threading of resistance members for attachment of one end of the resistance member to the device.

2) The use of strategically placed base apertures located inwardly of respective peripheral edges of the base that allow the resistance members to be threaded through the apertures and not to be physically fastened or anchored to the base.

3) New and not found in the prior art; the use of a plurality of resistance members threaded through apertures strategically placed on the device which when pulled or pushed at different angles provide different degrees of resistance.

The resistance members when extended outward from a base aperture at a severe angle (e.g. chest press exercise) provide more resistance than when the resistance members are extended upward from a base aperture at a minimal angle where the resistance members slide through the aperture (e.g. shoulder press exercise).

4) New and not found in the prior art and based on the threading of resistance members through base apertures is the ability to adjust the resistance for an exercise by pulling or sliding an additional length of the resistance members beyond the base aperture closest to the gripping device prior to starting the exercise. The adjustment where an additional resistance member length is beyond the closest base aperture to the gripping device decreases the resistance when performing the exercise.

Additionally the resistance for an exercise can be increased by pulling or sliding an additional portion of the resistance member not beyond the closest aperture to the gripping device but to the other side of the aperture prior to starting the exercise.

5) The ability to easily and conveniently attach or detach threaded resistance members, resistance members with different resistance levels, only to the gripping devices in order to increase or decrease resistance for an exercise. Alternatively when resistance members with permanently attached gripping devices are used multiple gripping devices can be gripped or released by the user to increase or decrease resistance for an exercise or stretching.

6) The minimal and not complex required parts; the resistance members (that are well known and readily available on the market today) and the base (that can include two attached common seat cushions) with base apertures (which can be common webbing straps). The minimal, common and not complex parts simplify and minimize the complexity, time and cost required to manufacture the portable exercise device and also allows the device to be sold at an affordable price.

7) Not found in the prior art (with a single device); the ability of the user to perform multiple chest, shoulders, back, arms, abdominal and leg exercises.

Chest press, incline press and chest/pec fly exercises can be performed using the portable exercise device exercising the chest pectoral muscles of the user.

Military press, shoulder raises and shoulder shrugs exercises can be performed using the portable exercise device exercising shoulder deltoid muscles of the user.

Overhead triceps press, forward triceps extension and chest press exercises can be performed using the portable exercise device exercising the triceps muscles of the user.

Wrist curl and reverse wrist curl exercises can be performed using the portable exercise device exercising the forearm muscles of the user.

Bicep curl and reverse bicep curl exercises can be performed using the portable exercise device exercising the biceps muscles of the user.

Row and shoulder shrugs exercises can be performed using the portable exercise device exercising the back muscles of the user.

Abdominal crunch, reverse abdominal crunch, oblique crunch and oblique twist exercises can be performed using the portable exercise device exercising the abdominal and oblique muscles of the user.

Squats, calf raises and lunges exercises can be performed using the portable exercise device exercising the leg muscles of the user.

All the exercises mentioned above and others can be performed comfortably with the user sitting or lying on the base. Additionally, the portable exercise device can be used on the floor with the user standing on a portion of the base.

Squats, calf raises and lunges exercising the leg muscles of the user can be performed using the portable exercise device with the user in a standing position.

All the exercises mentioned and others can be performed with ease of use and convenience, by the positioned gripping devices ready for any and all exercises, the ability to easily change resistance levels by attaching or detaching resistance members to the resistance member gripping devices (and with the resistance members having different resistance levels), by the ease of adjusting the resistance of the resistance members, by the ability of the user to stay in the same position (sitting, lying or standing) for all exercises, by the flexibility of using resistance members verses dumbbells and by the ability to use the portable exercise device on any sitting or lying means, as well as the floor for standing exercises.

Also with the multiple exercises available to the user using the portable exercise device and the device's ease of use; the positioned handles ready for any and all exercises, the ability to easily change resistance levels and the ability of the user to stay in the same position for all exercises, the time for the user to complete a workout is minimized and often can be less than five minutes.

The portable exercise device allows users, who may be confined to a wheelchair or bed to be able to exercise, stretch or perform various types of physiotherapy, from the comfort of their chair or bed.

By the ability of the user to use the portable exercise device on any sitting or lying means or in a standing position for a variety of exercises, and to perform the exercises with one or two hands the portable exercise device can be a valuable tool for physical therapy.

It is further contemplated that the portable exercise device can be used sitting in a vehicle, including but not limited to a car, a truck, a bus, a train, an airplane or any other similar vehicle.

It is to be understood that this general description, the detailed description which follows, and exercises mentioned using the portable exercise device while exemplary and explanatory, are not restrictive of the portable exercise device.

The accompanying drawings, which are incorporated in and constitute part of this specification, illustrate the embodiments of the portable exercise device and exercises using the portable exercise device and together with the description, serve to explain the principles of the invention.

BRIEF DESCRIPTION OF THE DRAWINGS

The portable exercise device will be described in further detail below and with reference to the attached drawings in which the same or similar elements are referred to by the same reference number, and where:

FIGS. 28A-28B are perspective views of a user of the portable exercise device performing an abdominal crunch exercise.

LIST OF REFERENCE NUMERALS IN DRAWINGS

Figure 1:
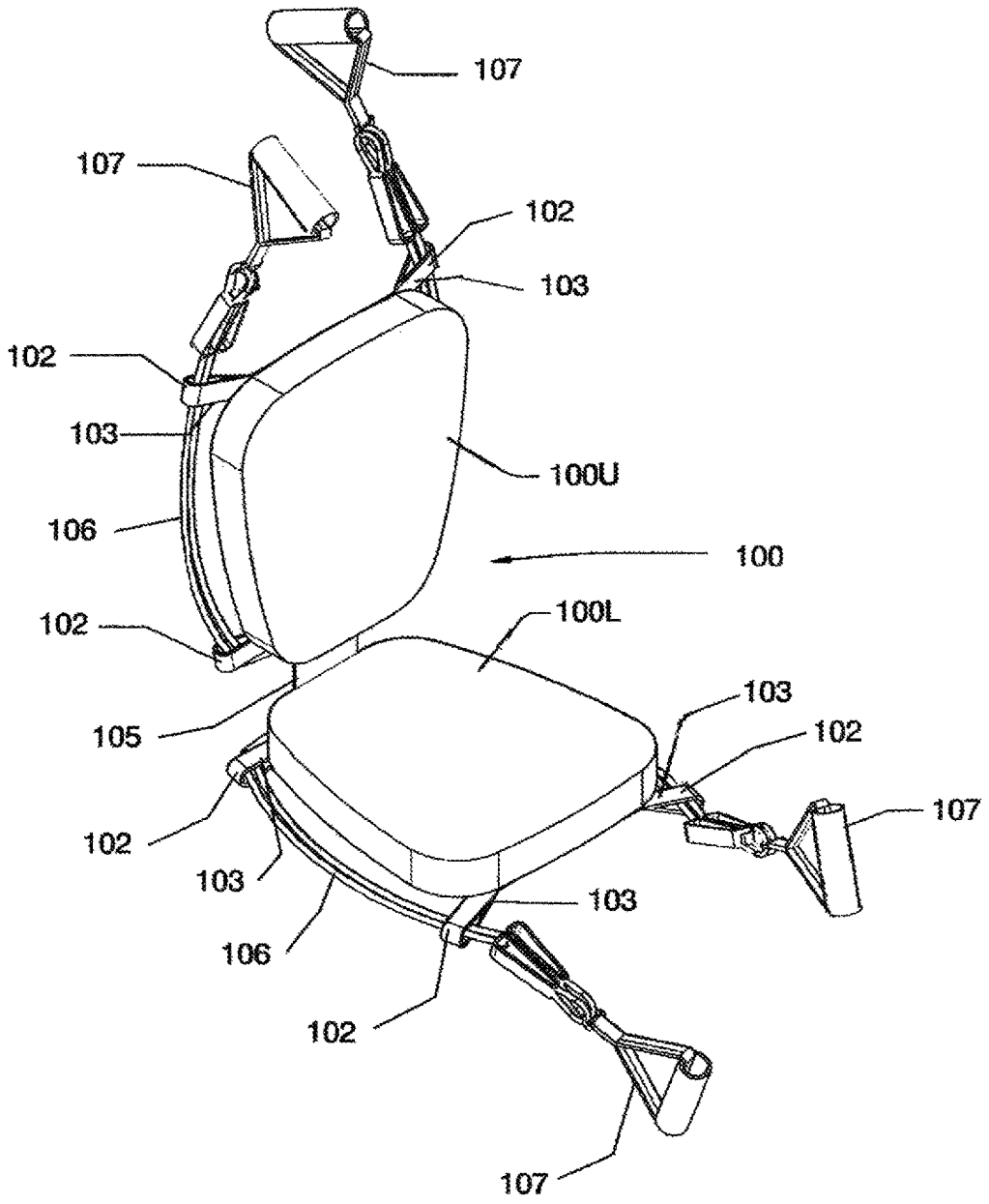
FIG. 1 is a front perspective view of one embodiment of the portable exercise device.

The first or first and second digits of the reference numerals below indicate which figure the element is introduced on; 100-107 FIG. 1, 1000-1004 FIG. 10.

100 base
100U upper base member
100L lower base member
102 base aperture
103 base aperture strap
105 upper and lower base member attachment
106 resistance member
107 resistance member gripping device
500 grommet
800 resistance member attachment hook
900 upper and lower base member attachment aperture
1000 base strap aperture
1002 base "O" ring aperture
1004 base "D" ring aperture
1006 base hook aperture
1400 resistance band
1403 resistance member attachment ring
1405 resistance member gripping device attachment hook
1406 resistance member gripping device attachment ring
1408 resistance member gripping device strap
1409 resistance member gripping device tube
1500 couch
1700 chair
1900 bed

DETAILED DESCRIPTION

Referring now to the drawings wherein the showing is for the purpose of illustrating embodiments and operation of the invention only and not for the purpose of limiting the same.

Figure 2:
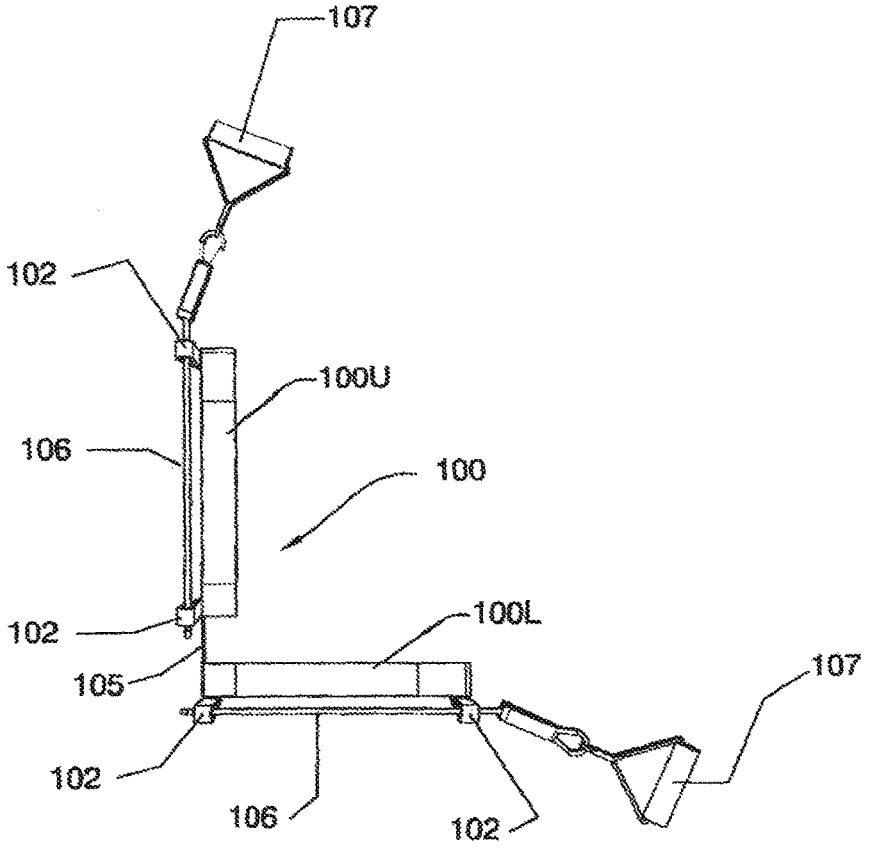
FIG. 2 is a side perspective view of the portable exercise device shown in FIG. 1.
Figure 3:
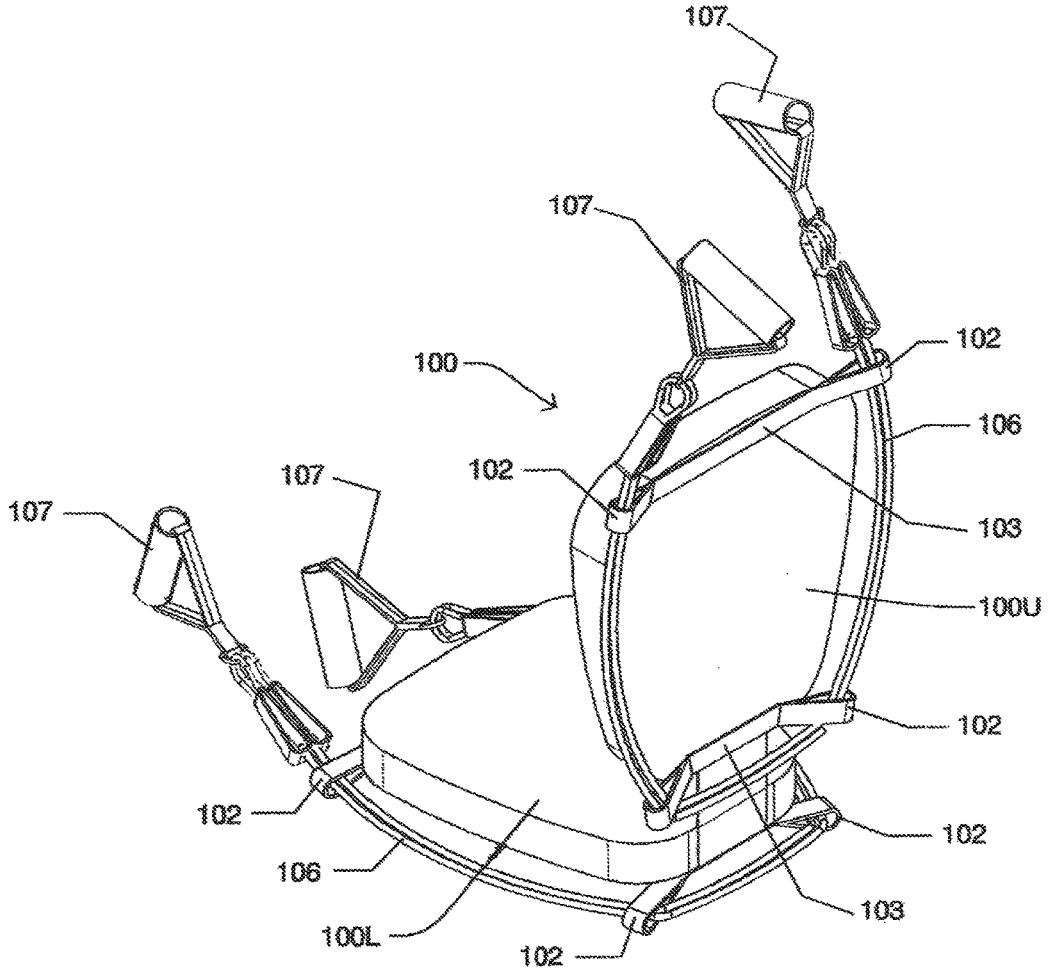
FIG. 3 is a back perspective view of the portable exercise device shown in FIG. 1.

FIG. 1-3—Main Embodiment

Referring now to FIG. 1, a perspective view of an embodiment of the portable exercise device is shown. The portable exercise device includes a base 100 that is configured with a upper base member 100U and lower base member 100L which include a plurality of base apertures 102 located outwardly of respective peripheral edges of the base to facilitate exercises with resistance members 106. The resistance members are threaded through the base apertures and are otherwise unattached to the base. Each resistance member has both ends free, with each end having a resistance member gripping device 107.

Three base apertures are shown in FIG. 1 (one is hidden) as part of the upper base member and three (one is hidden) as part of the lower base member. The base apertures are connected to the upper and lower base members with a base aperture strap 103 in this illustration. Four resistance members are shown in FIG. 11 with one set of two resistance members threaded through base apertures of the upper base member and one set of two resistance members threaded through apertures of the lower base member. Each set of resistance members has a single resistance member gripping device at each end of the resistance members in the set.

The portable exercise device is symmetrically configured about a generally central axis dimensioned for placement of a lower base member under the buttocks of the user and an upper base member behind the back of a user. The device can be used with and unattached to, any type of conventional sitting or lying means, including but not limited to a home or office chair, having a back or not, cushioned or not cushioned, having arms or not arms; a bench; a stool; a sofa; a couch; a wheel chair; a bed or any other structure designed for sitting or lying.

It is further contemplated that the portable exercise device can be positioned underfoot of the user while performing exercises in a standing position.

The portable exercise device lower base member or the lower section of a one piece base, upon which the user would sit, provides immovable contact and support for the exercises of the device.

The portable exercise device can be dimensioned to accommodate a range of users of different statures, weights and strengths.

It is further contemplated that the portable exercise device can be used sitting in a vehicle including but not limited to a car, a truck, a bus, a train, a plane or any other similar vehicle.

Accordingly the base can include an upper base member and a lower base member which can consist of durable pieces of material or padded cushions with different shapes; square, rectangular, elliptical or any other suitable shape.

In one aspect of the portable exercise device the upper base member would be a lumbar cushion.

In another aspect of the portable exercise device the upper and lower base members would be identical cushions and be made of durable upholstery or canvas fabric with a 25 mm to 50 mm (half inch to two inch) foam or rubber interior. The dimensions of the cushions would be approximately 406 mm (sixteen inches) wide on one end and narrowing to 280 mm (eleven inches) on the other end and approximately 381 mm (fifteen inches) deep.

In several embodiments of the portable exercise device including the above embodiment the upper and lower base members could be padded seat cushions providing for improved comfort of the user. Padded seat cushions are common to the market today and therefore their use would eliminate the need to have new cushions designed and manufactured for the construction of the portable exercise device. The availability of common seat cushion products on the market today reduces the complexity, time and cost of bringing the exercise device to market.

The use of padded cushions for the portable exercise device upper and lower base members adds comfort to the user sitting, lying or standing on the device.

The upper and lower base members described or mentioned above are aspects of the portable exercise base members only and not for the purpose of limiting the same.

FIG. 1 shows an upper and lower base member attachment 105 that allows the flexibility of the lower and upper base members to rotate from a 0 degree to 180 degree angle allowing the portable exercise device to be used on any seating or lying means. The upper and lower base member attachment can be any elastic or non-elastic piece of material capable of withstanding tensile and shear forces.

In one aspect of the portable exercise device a 50 mm to 152 mm (two to six inches) wide by 101 mm to 203 mm (four to eight inches) long piece of webbing nylon or polyester material would be used for the upper and lower base member attachment. It is further contemplated that the portable exercise device could have more than one upper and lower base member attachment for further attachment security.

The upper and lower base member attachment attaches the lower base member, which provides immovable contact when sat upon by the user, and the upper base member. The upper and lower base member attachment, along with the immovable lower base member (when sitting, lying or standing upon), provides support for the upper base member including resistance exercises using the upper set of resistance members threaded through base apertures of the upper base member. The support for the resistance exercises with the upper set of resistance member allows for performing exercises with limited or no pressure of the user's back and upper base member to the back of a sitting means including using the exercise device on a stool or similar sitting means.

The upper and lower base member attachment described above is an aspect of the portable exercise device only and not for the purpose of limiting the same Two sets of resistance members are shown in FIG. 1, one set for the upper base member and one set for the lower base member with the resistance members threaded through the base apertures and unattached to the base. Each set of resistance members in FIG. 1 includes two resistance members with free ends, each end of the resistance members with a single resistance member gripping device (two resistance member gripping devices at each end per set, not per resistance member).

Although the portable exercise device is shown in FIG. 1 with two sets of two resistance members, it is contemplated that with all embodiments of the portable exercise device, each set of resistance members can use a plurality of resistance members or a single resistance member, depending on the particular needs or desires of the user. Each resistance member, with two free ends, neither end nor any portion of each resistance members fastened or anchored to said base, both ends with a resistance member gripping device (multiple resistance members connecting to the same resistance member gripping device).

Accordingly in certain aspects of the portable exercise device the resistance members can be elastic resistance tubes or bands that can be stretched against their natural resistance. Including elastic resistance tubes that are braided, corded or sleeved. The resistance members can be made of latex, rubber, silicone or any other suitable elastic material, be of equal length, approximately 1200 mm (four feet) in length and be of different resistance levels.

The resistance level of a resistance tube resistance member is determined by thickness of the resistance tubes, which will generally range from an outer diameter of 7 mm to 13 mm and the inner hollow diameter will generally range from an inner diameter of 4 mm to 6 mm. The greater the outer diameter and smaller the inner diameter of the resistance tube the greater the resistance.

The different resistance levels of the resistance members will allow the user to easily and simply adjust resistance levels for an exercise by attaching or detaching the desired resistance members to the resistance member gripping devices. Typically each set of resistance members will be threaded through the base apertures and be available for attaching or detaching to the resistance member gripping devices when the user is adjusting resistance levels.

In several embodiments of the portable exercise device elastic resistance tube resistance members with the approximate length indicated could be used, this allows for the use of resistance tube products that are common to the market today and therefore eliminates the need to have a new resistance members designed and manufactured for the making of the portable exercise device. The availability of common resistance tube products that could be part of the exercise device reduces the complexity, time and cost of bringing the device to market.

It will be apparent that the number of resistance members used, as well as the resistance levels of the resistance members, can vary to provide different resistance levels for exercises to accommodate individuals of different stature and strength.

The resistance members described and mentioned are an aspect of the portable exercise device only and not for the purpose of limiting the same.

The resistance member gripping device would typically be a common flexible handle; comprising webbing straps threaded through a padded or unpadded tube and a connection ring or hook.

It is further contemplated that the portable exercise device would not require resistance member gripping devices but that the user could only hold on to the end of the resistance tube or band or a loop at the end of the resistance tube or band.

The resistance member gripping devices mentioned are an aspect of the portable exercise device only and not for the purpose of limiting the same.

The portable exercise device of the embodiment described in FIG. 1 is light weight, having an approximate weight of three to five pounds.

Referring now to FIG. 2, a perspective side view of the portable exercise device shown in FIG. 1. The portable exercise device includes a base 100 that consists of attached upper and lower base members 100U 100L with a plurality of base apertures 102 located outwardly of respective peripheral edges of the base member and two sets of resistance members 106. The upper base member and the lower base member are attached by an upper and lower base member attachment 105. One set of resistance members are threaded through the upper base member base apertures and one set of resistance members are threaded through the lower base member base apertures. Each set of resistance members includes one resistance member and each resistance member has both ends free, with each end having a resistance member gripping device 107 (one resistance member gripping device for each resistance member is hidden from view).

In the perspective side view of FIG. 2 each resistance member is threaded through four base apertures (two base apertures for each resistance member are hidden from view).

FIG. 3 is a perspective back view of the portable exercise device shown in FIG. 1. The portable exercise device includes a base 100 that is configured with an upper base member 100U and lower base member 100L which include a plurality of base apertures 102 located outwardly of respective peripheral edges of the base and two sets of resistance members 106.

As illustrated in FIG. 3 the base includes the upper base member with a plurality of base apertures located outwardly of respective peripheral edges of the base to facilitate resistance members for exercise purposes. Four base apertures are shown as part of the upper base member and three (one base aperture is hidden from view) base apertures can be seen on the lower base member. The base apertures are connected to the upper and lower base members with base aperture straps 103 sewn laterally across the width of the cushion for additional support of the base apertures. Two sets of resistance members are shown, one set for the upper base member and one set for the lower member, with the resistance members threaded through the base apertures. Each set of resistance members includes two resistance members, each with two free ends having a single resistance member gripping device 107 at each end.

Figure 4A:
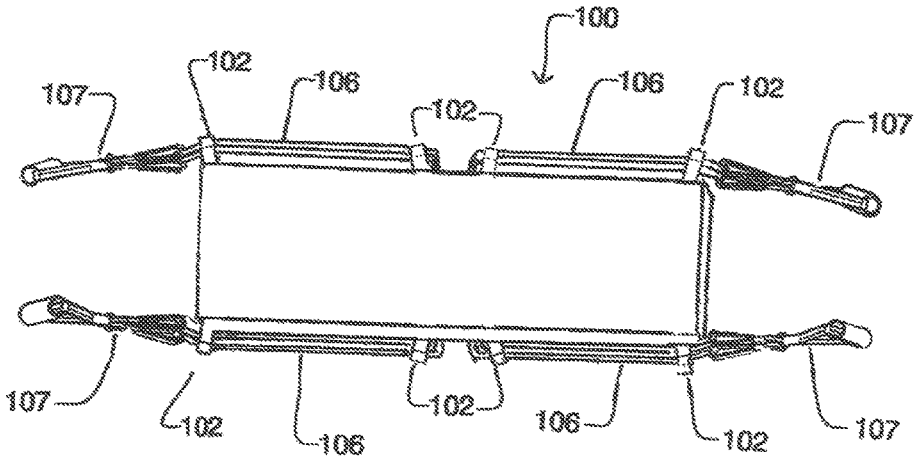
FIGS. 4A-4B are a front and back perspective views of another embodiment of the portable exercise device with a one piece base.
Figure 4B:
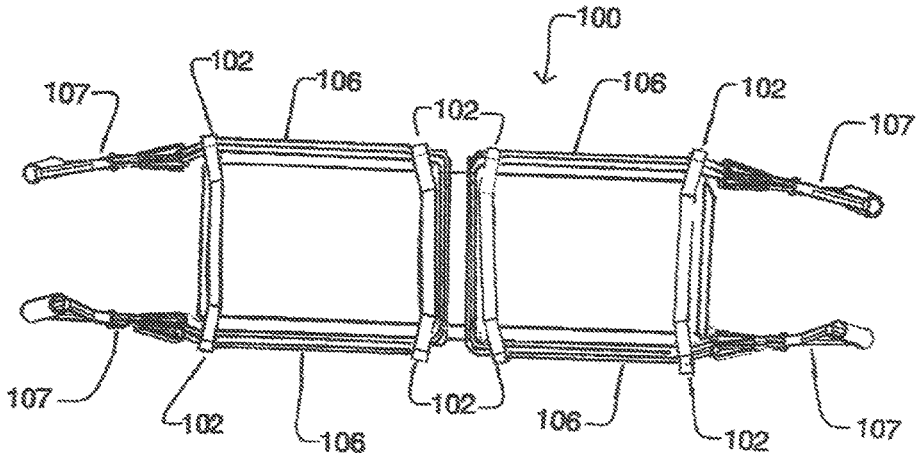

FIGS. 4A and 4B—Alternative Embodiment with a One Piece Base

Referring now to FIGS. 4A and 4B, is perspective top and bottom views of an alternative embodiment of the portable exercise device including a one piece flexible base 100. Accordingly the base can generally be a single foldable cushion with an upper and lower portion, a resilient piece of fabric or a mat. In this embodiment the one piece base is shown in FIGS. 4A and 4B to be rectangular, but in other aspects the one piece base would be oval, elliptical or any other suitable shape. The one piece base can be made of latex, rubber, foam rubber, silicone, nylon, canvas or polyester or any other suitable material.

Two sets of resistance members 106 are shown in FIGS. 4A and 4B with the resistance members threaded through eight base apertures 102 located outwardly of the base. Each set of resistance members includes two resistance members, each resistance member with two free ends, each free end having a single resistance member gripping device 107.

Figure 5A:
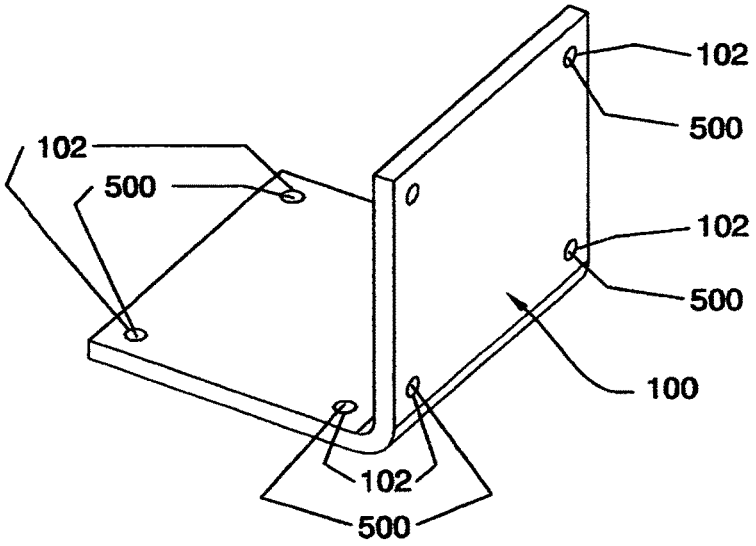
FIGS. 5A-5B are back perspective views of another embodiment of the portable exercise device with a one piece base including inward base apertures.
Figure 5B:
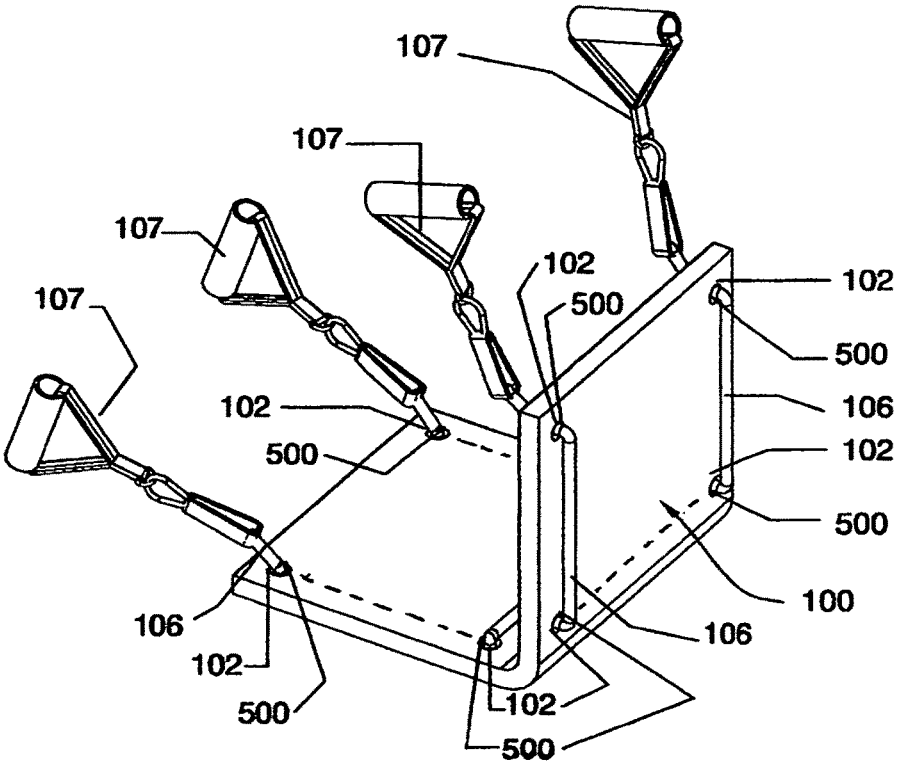

FIGS. 5A and 5B—Alternative Embodiment with Inward Base Apertures

FIGS. 5A and 5B show a perspective view of another embodiment of a portable exercise device with a flexible base 100 that is configured as one piece. In this embodiment the base apertures 102 are located inwardly of the base and base apertures are reinforced by grommets 500. FIG. 5B shows the portable exercise device with two sets of resistance members 106 threaded through the base apertures with grommets, each set of resistance members is a single resistance member having a resistance member gripping device 107 at each free end.

It is contemplated that the base apertures in FIGS. 5A and 5B could be reinforced by stitching instead of the grommets or may not need additional support at all with some materials.

Figure 6A:
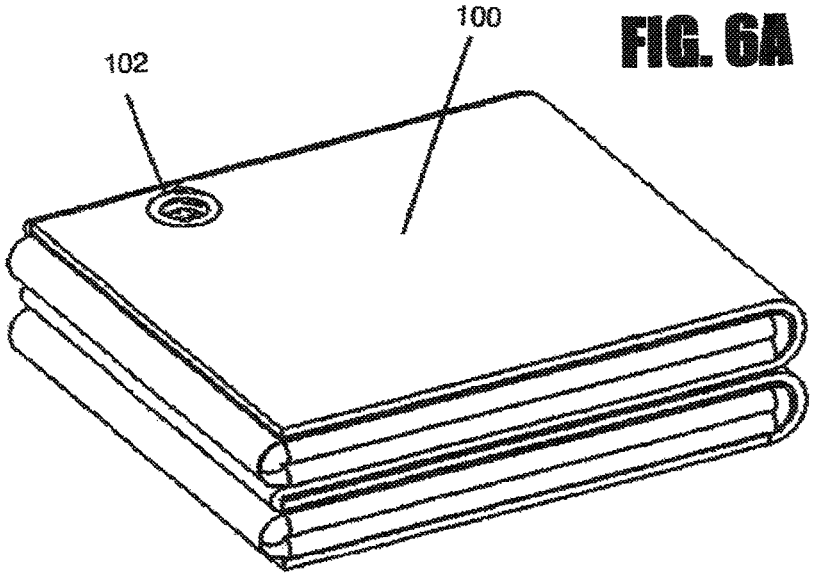
FIGS. 6A-6B are perspective views of various ways in which the portable exercise device of FIG. 4A, 4B, 5A or 5B can be compacted for storage and portability.
Figure 6B:
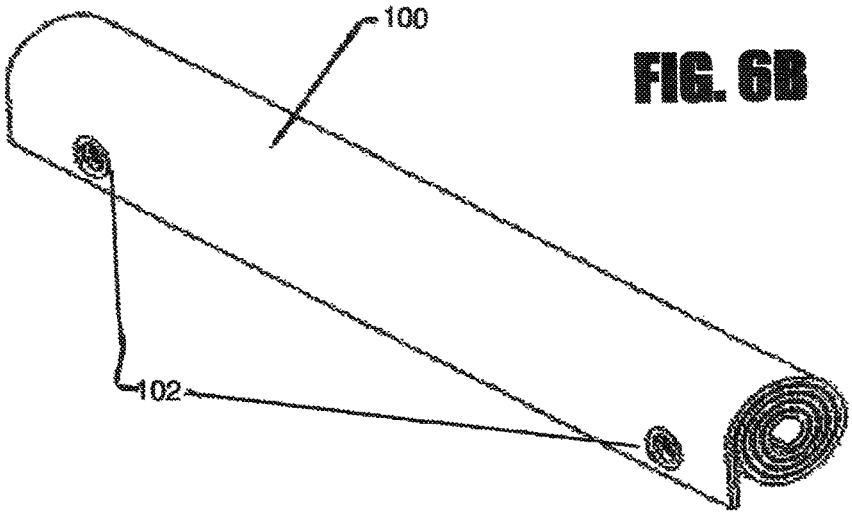

FIGS. 6A and 6B show various ways in which the portable exercise device with a one piece base 100 can be compacted for storage and portability. Base apertures 102 located inwardly of the base are also shown.

Advantageously, the portable exercise device of the embodiments shown in FIGS. 4A and 4B and FIGS. 5A and 5B allow the user to fold (FIG. 6A) or roll (FIG. 6B) or otherwise compact the device base for extreme portability and ease of carrying, storage or insertion into a carrying case. Resistance members, not shown in FIGS. 6A and 6B, are easily removable from the base and can be stored in a small carry bag for storage and portability.

FIG. 6A shows an embodiment of the portable exercise device with the base folded. FIG. 6B shows an embodiment of the portable exercise device with the base rolled. These various compactions are possible due to the lack of any rigid support members in certain embodiments of the portable exercise device.

While FIGS. 6A and 6B show certain embodiments of the portable exercise device compacted without the resistance members. It is contemplated that the device can also be compacted with resistance members threaded through the base apertures for convenience and portability.

Figure 7A:
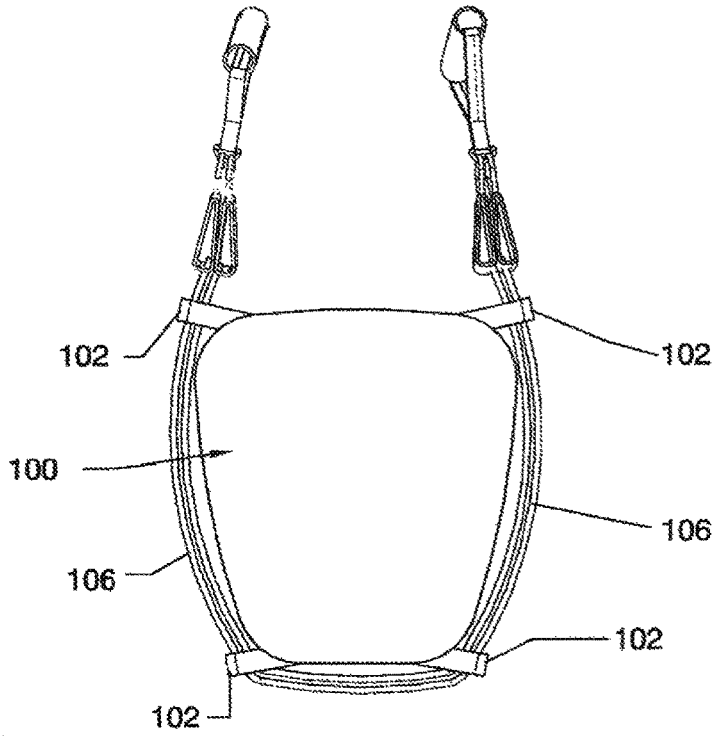
FIGS. 7A-7B are front and back perspective views of another embodiment of the portable exercise device with a one piece base to be used below and behind the user.
Figure 7B:
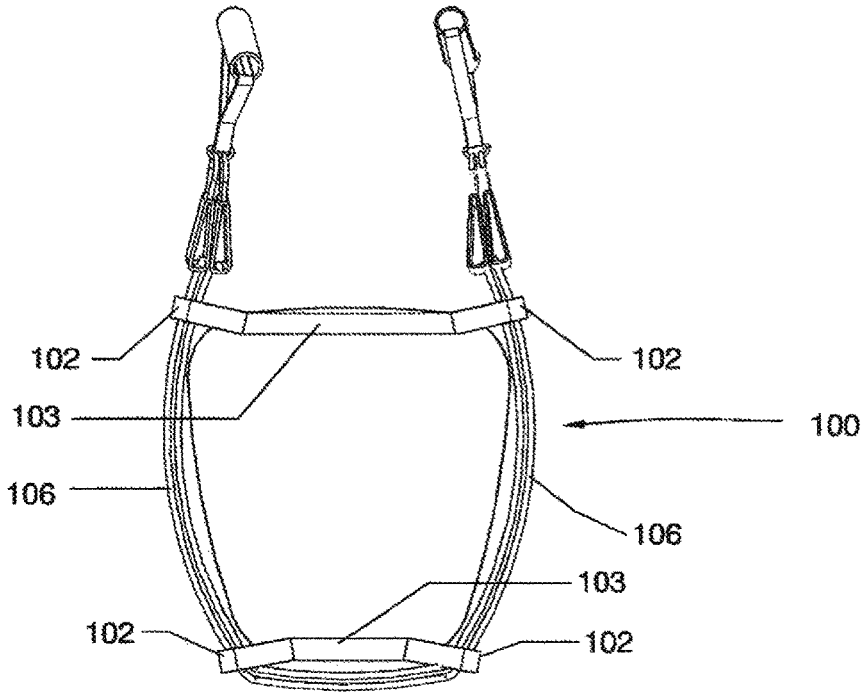

FIGS. 7A and 7B—Alternative Embodiment with a Positional One Piece Base

FIGS. 7A and 7B show a perspective front and back view of another embodiment of the portable exercise device with a base 100 that is one piece with a plurality of base apertures 102 located outwardly of respective peripheral edges of the base and one set of two resistance members 106. The base apertures have supporting base aperture straps 103 shown in FIG. 7B back view. With this embodiment configured with a single piece base, the user can place the base under the buttocks for exercises and then move the base to behind the back for other exercises.

The embodiment of the portable exercise device shown in FIGS. 7A and 7B has the advantage of increased portability, is simpler and with less parts the device could be manufactured and sold at a reduced cost and price.

Figure 8:
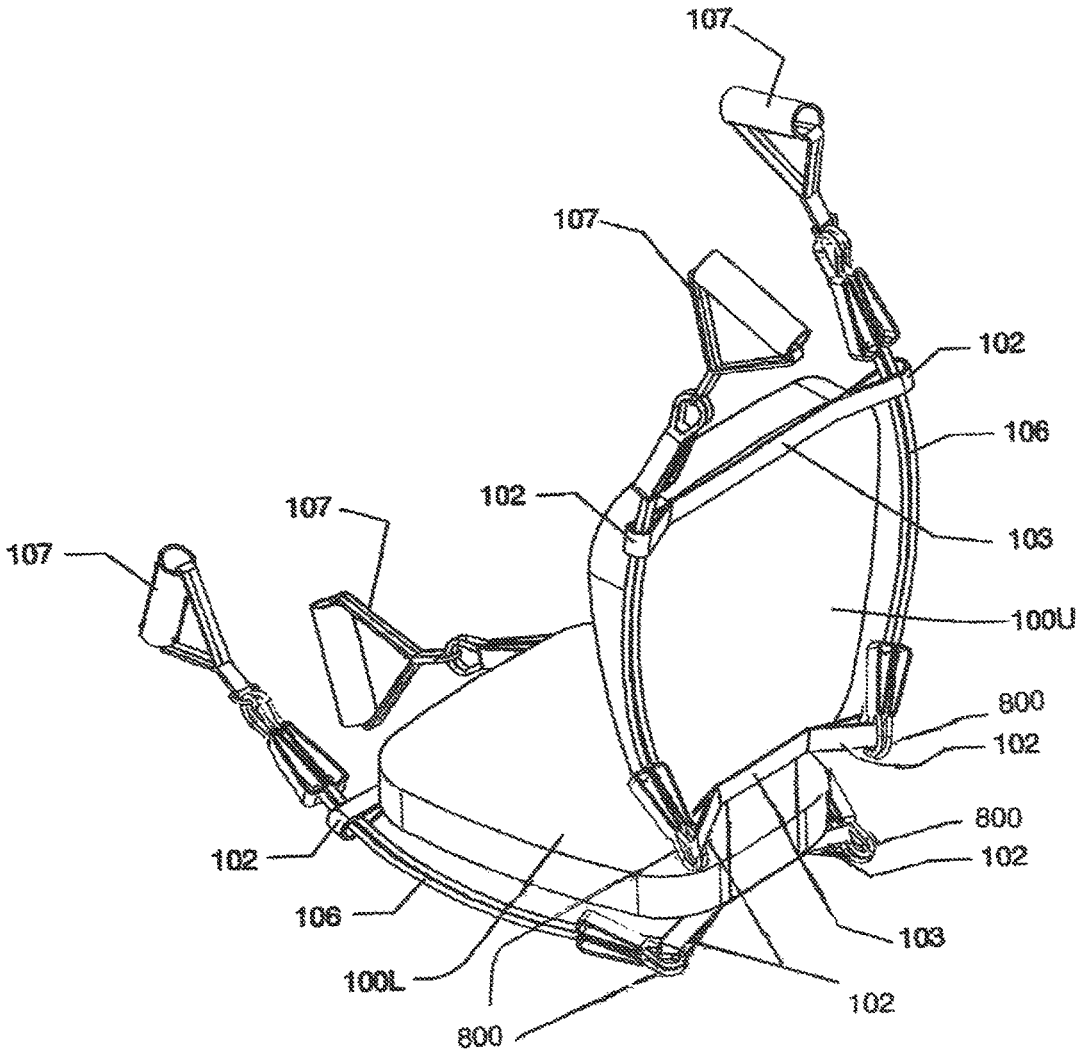
FIG. 8 is a front perspective view of another embodiment of the portable exercise device with resistance members both attached to and threaded through base apertures.

FIG. 8—Alternative Embodiment with Attached and Threaded Resistance Members

FIG. 8 shows a perspective view of another embodiment of the portable exercise device with upper and lower base members 100U 100L with a plurality of base apertures 102 located outwardly of respective peripheral edges and a plurality of resistance members 106, each resistance member with one free end. The free ends of the resistance members have a resistance member gripping device 107.

With the embodiment of the portable exercise device in FIG. 8 the resistance members are threaded through base apertures located at the top of the upper base member and at the front end of the lower base member near the resistance member gripping devices. The resistance members are also attached to the base apertures with resistance member attachment hooks 800 located at the bottom of the upper base member and the back end of the lower base member. The base apertures are connected to the upper and lower base members with a base aperture strap 103 in this illustration.

The embodiment of the portable exercise device shown in FIG. 8 has the advantage of the resistance members being shorter than in other embodiments and that the resistance members do not cross the base member.

It is contemplated that the embodiments of the portable exercise device shown in FIGS. 1, 2 and 3, FIGS. 4A and 4B, FIGS. 5A and 5B and FIGS. 7A and 7B could have resistance members attached to the base apertures furthest from the resistance member gripping devices as described in FIG. 8.

Figure 9A:
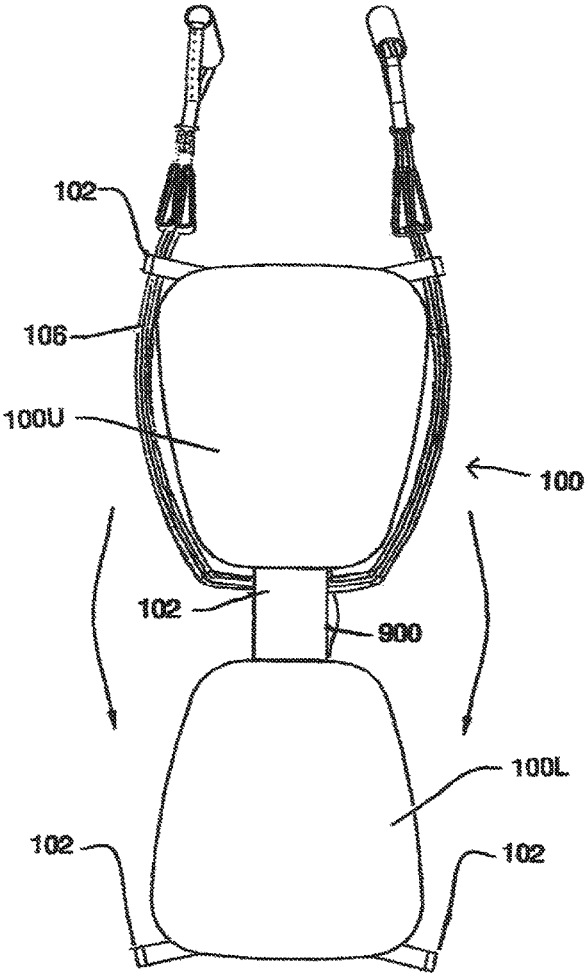
FIGS. 9A-9B are perspective views of another embodiment of the portable exercise device with the same resistance members used with the upper and lower base members.
Figure 9B:
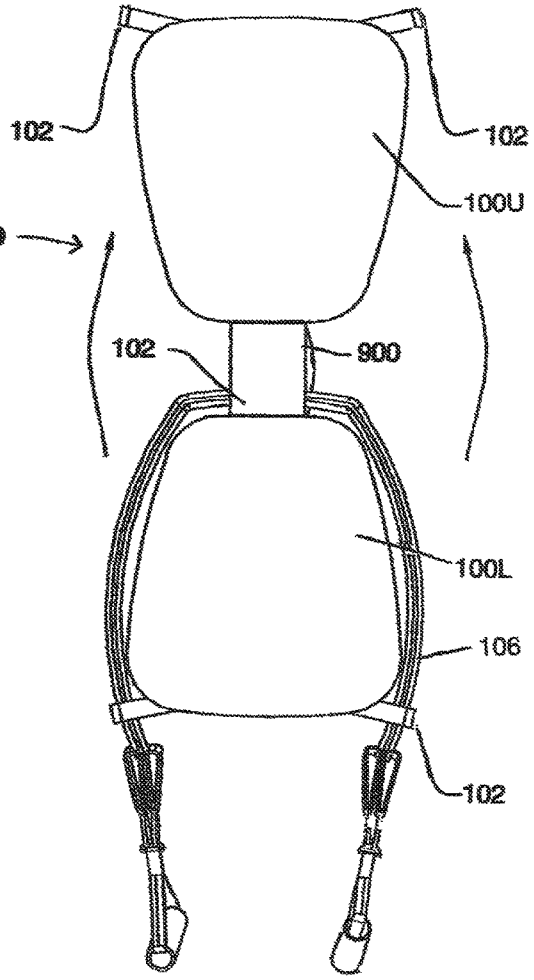

FIGS. 9A and 9B—Alternative Embodiment with One Set of Resistance Members FIGS. 9A and 9B show a perspective view of another embodiment of a portable exercise device with a base 100 that is consisting of upper and lower base members 100U 100L with five base apertures 102 and one set of two resistance members 106.

Also shown in FIGS. 9A and 9B is an upper and lower base member attachment aperture 900 witch attaches the upper base member and the lower base member and allows resistance members to be threaded through. In this embodiment of the portable exercise device the set of resistance members can be rotated from the base apertures of the upper base member as shown in FIG. 9A to the base apertures of the lower base member as shown in FIG. 9B by simply detaching the resistance member gripping devices from the resistance members of the upper base member, pulling the resistance member from the base aperture of the upper base member, threading the resistance members through the base apertures of the lower base member and then reattaching them to the resistance member gripping devices. The resistance members would remain threaded through the upper and lower base member attachment aperture.

It is also contemplated that the base apertures of the upper base member and the lower base member, excluding the upper and lower base member attachment aperture, are base hook apertures. This would enable leaving the resistance members threaded through the upper and lower base member attachment aperture and without detaching the resistance member gripping devices, pulling the resistance members out of the spring arm clipping mechanism of the base hook apertures of the upper base member and then pushing the resistance members into the base hook apertures of the lower base member.

With this embodiment the same set of resistance members could be used with the upper and lower base members. Only one set of resistance members with gripping devices would be required for the portable exercise device with this embodiment.

The base member hook apertures will typically be a spring catch snap hook, fixed eye hook or "S" clip with or without a swivel eye bolt. The spring catch snap hook, fixed eye hook, carabiner or "S" clip allows for threading resistance members through or pushing into or pulling out of, with its spring arm.

The embodiment of the portable exercise device shown in FIGS. 9A and 9B has the advantage of using one set of resistance members and therefore the device could be manufactured and sold at a reduced cost and price.

It is contemplated that the embodiment of the portable exercise device shown in FIGS. 9A and 9B could have resistance members threaded through both the upper and lower base member base apertures and the resistance members could be moved between the upper and lower base member as needed by the user to best perform an exercise.

FIGS. 10A-10F show a perspective view of various base apertures located inwardly and outwardly of respective peripheral edges of the base.

Figure 10A:
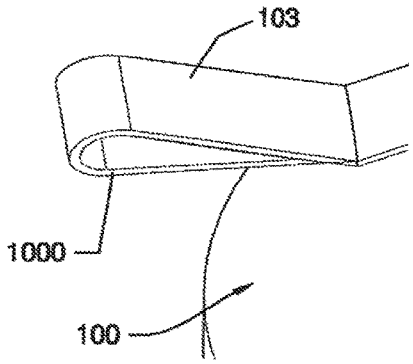
FIGS. 10A-10F are perspective views of various outward and inward base apertures.

FIG. 10A is a base strap aperture 1000 formed by the looping of the end of a base aperture strap 103 and is located outwardly of respective peripheral edges of the base 100.

Figure 10B:
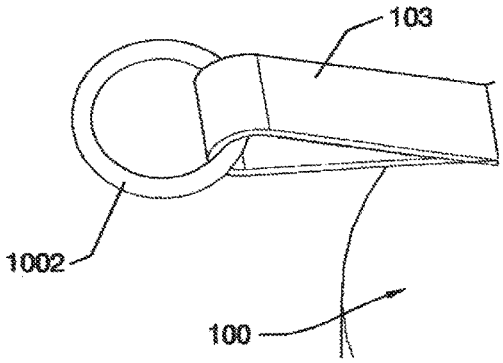
Figure 10C:
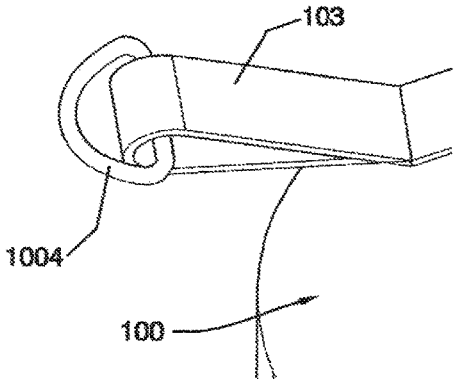
Figure 10D:
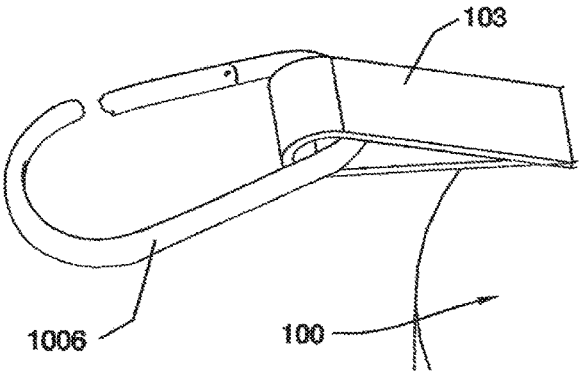
Figure 10E:
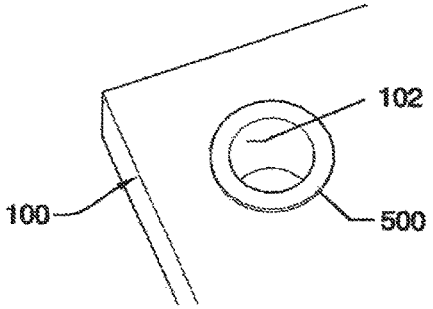
Figure 10F:
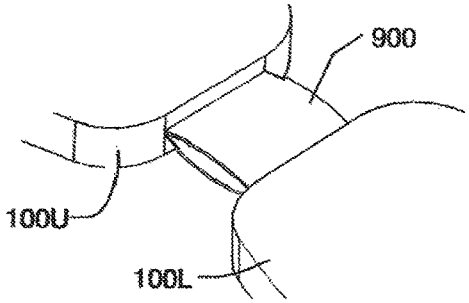

In several aspects of the portable exercise device the base apertures (excluding the aperture formed by the attachment of the upper and lower base members described in FIG. 10F) would be made from base aperture straps forming loops as in FIG. 10A.

Using base strap apertures for the base apertures (FIG. 10A) reduces the complexity of manufacturing the portable exercise device and eliminates the need for an additional part, like base apertures made with metal or rubber rings or hooks.

FIG. 10B shows a base "O" ring aperture 1002 formed by base aperture strap 103 around a metal or rubber "O" ring. The "O" ring aperture is located outwardly of respective peripheral edges of the base 100. The "O" rings will typically have a diameter of 25 mm to 51 mm (one to two inches).

FIG. 10C shows a base "D" ring aperture 1004 formed by a base aperture strap 103 around a metal or rubber "D" ring. The "D" ring aperture is located outwardly of respective peripheral edges of the base 100. The "D" rings will typically have a diameter of 25 mm to 51 mm (one to two inches).

FIG. 10D shows a base hook aperture 1006 formed by a base aperture strap 103 around a metal hook. The base hook aperture is located outwardly of respective peripheral edges of the base 100.

The metal hook for the base hook aperture will typically be a spring catch snap hook, fixed eye hook, carabiner or "S" clip with or without a swivel eye bolt and have a diameter at its largest point of 19 mm to 51 mm (three quarters of an inch to two inches). The spring catch snap hook, fixed eye hook, carabiner and "S" clip allow for threading resistance members through, pushing into or pulling out of using the spring arm of these hooks.

The base aperture straps shown in FIGS. 10A-10D will typically be made of industrial strength webbing nylon or polyester material and be a 13 mm to 51 mm (half inch to two inches) wide.

FIG. 10E shows a base aperture 102 with a reinforcing grommet 500 located inwardly of respective peripheral edges of the base 100. The grommet will typically be metal and have a diameter of 19 mm to 51 mm (three quarters of an inch to two inches). The inward base aperture can also be supported by stitching instead of a grommet.

FIG. 10F shows an upper and lower base member attachment aperture 900 located outwardly of respective peripheral edges of the base.

The upper and lower base member attachment aperture (FIG. 10F) attaches the upper base member 100U to the lower base member 100L and can be two pieces of material or one piece of material folded in half with an aperture formed by the separation of the unconnected/unsewn central portion of the material. The material used for this aperture can be elastic or non-elastic material of sufficient strength to withstand tensile and shear forces.

Referring now to the various base apertures shown in FIGS. 10A-10F the showing is for describing aspects of base apertures of the portable exercise device only and not for the purpose of limiting the same.

FIGS. 11A-11F show a perspective view of various base apertures with a plurality of resistance members threaded through the apertures.

Figure 11A:
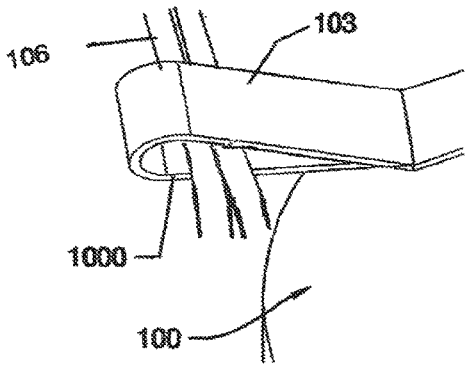
FIGS. 11A-11F are perspective views of various outward and inward base apertures with resistance members threaded through the apertures.

FIG. 11A shows a base strap aperture 1000 located outwardly of respective peripheral edge of the base 100 with two resistance members 106 threaded through the aperture. A base aperture strap 103 is also shown connecting the base aperture to the base.

Figure 11B:
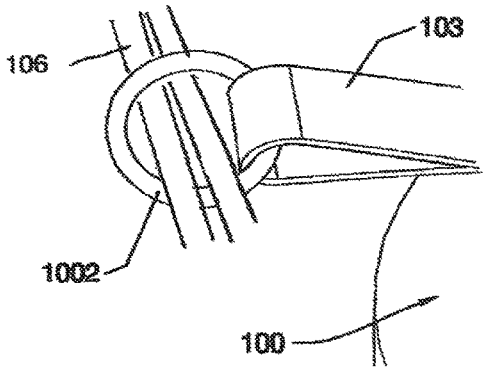

FIG. 11B shows a base "O" ring aperture 1002 located outwardly of respective peripheral edge of the base 100 with two resistance members 106 threaded through the aperture. A base aperture strap 103 is also shown connecting the base aperture to the base.

Figure 11C:
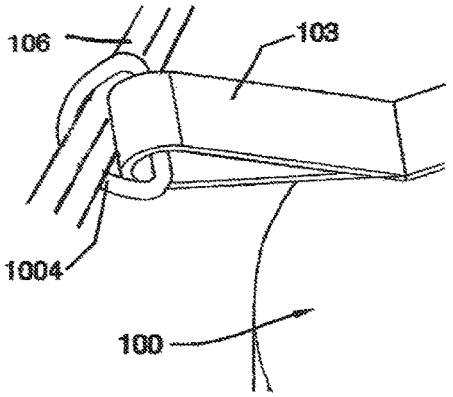

FIG. 11C shows a base "D" ring aperture 1004 located outwardly of respective peripheral edge of the base 100 with two resistance members 106 threaded through the aperture. A base aperture strap 103 is also shown connecting the base aperture to the base.

Figure 11D:
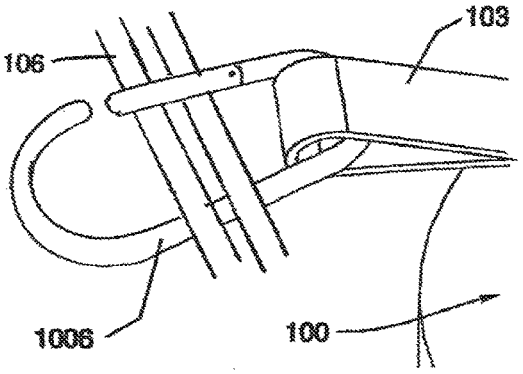

FIG. 11D shows a base hook aperture 1006 located outwardly of respective peripheral edge of the base 100 with two resistance members 106 threaded through the aperture. A base aperture strap 103 is also shown connecting the base aperture to the base.

Figure 11E:
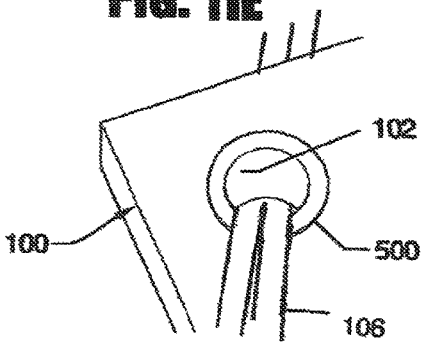

FIG. 11E shows a base aperture 102, including a reinforcing grommet 500, located inwardly of respective peripheral edge of the base 100 with two resistance members 106 threaded through the aperture.

Figure 11F:
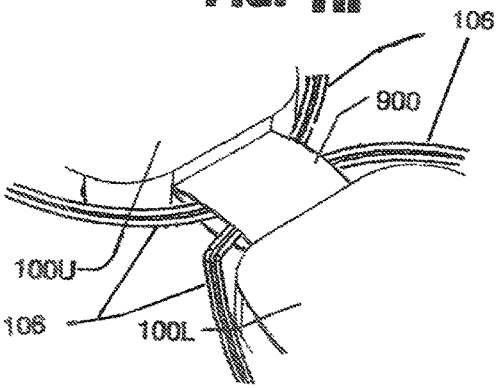

FIG. 11F shows an upper and lower base member attachment aperture 900 with a plurality of resistance members 106 threaded through the aperture.

FIG. 11F also shows the resistance members threaded through the upper and lower base member attachment aperture can be part of the upper and/or lower sets of resistance members. In this case the upper and lower base aperture is used for the both the threading of one or more resistance members that go along the upper base member 100U and the threading of the one or more resistance members that go along the lower base member 100L.

The portion of the resistance members threaded through the upper and lower base member attachment aperture of FIG. 11F can have sufficient tension/friction to the material of the aperture to prevent the resistance members from sliding in either direction when the resistance member is stretched. The stabilizing of resistance members at the centrally located base aperture can be of importance when the user is performing an exercise with only one arm and when performing an exercise where both hands grip one resistance member gripping device and the other gripping device is not gripped.

Although the base apertures are shown in FIGS. 11A-11F with two or four resistance members threaded through them, it is contemplated that in certain embodiments that a plurality resistance members or a single resistance member would be threaded through the base apertures depending on the particular needs or desires of the user.

FIGS. 12A-12E show a perspective view of connection methods of base apertures located outwardly of respective peripheral edges of the base.

Figure 12A:
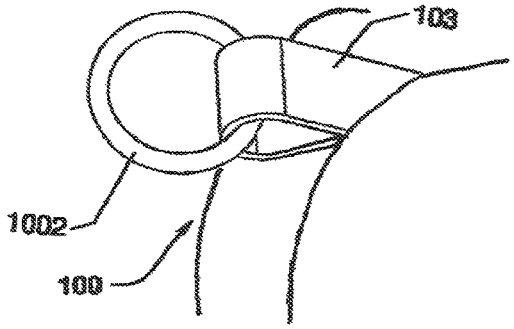
FIGS. 12A-12E are perspective views of various sewing connection methods of base apertures.

FIG. 12A shows a base "O" ring aperture 1002 with a base aperture strap 103 around the "O" ring that is sewn into the seam of a base 100.

Figure 12B:
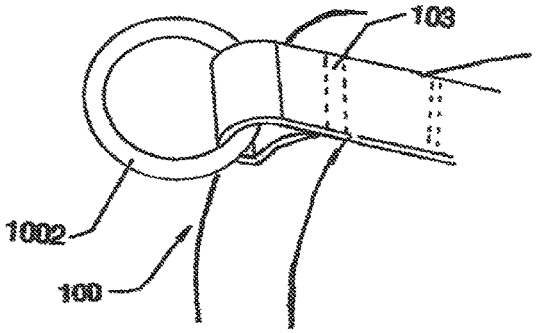

FIG. 12B shows a base "O" ring aperture 1002 with a base aperture strap 103 around the "O" ring that is sewn onto the back of a base 100 and sewn outward of the base near the "O" ring.

Figure 12C:
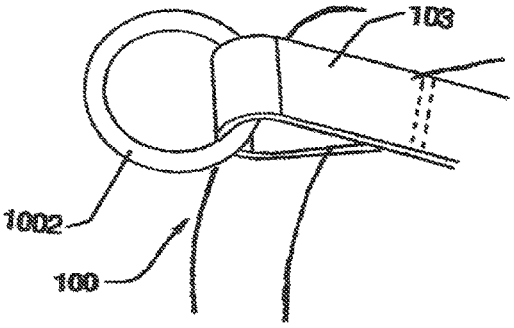

FIG. 12C shows a base "O" ring aperture 1002 with a base aperture strap 103 around the "O" ring that is sewn onto the back of a base 100.

Figure 12D:
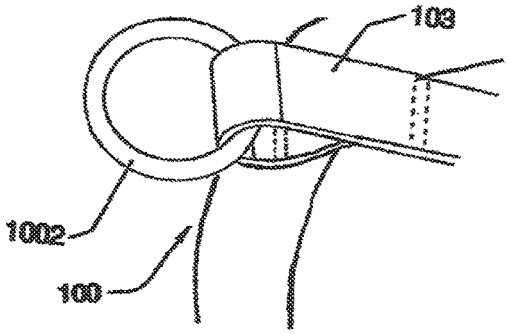

FIG. 12D shows a base "O" ring aperture 102 with a base aperture strap 103 around the "O" ring that is sewn onto the back of a base 100 and to the side of the base.

The base aperture strap used will typically be made of webbing industrial strength nylon or polyester material and be 13 mm to 51 mm (half inch to two inches) wide. The base aperture straps can be of short length, or be sewn across the entire upper or lower base member, whereby the same base aperture strap can be used with two base apertures. Base aperture straps sewn across the entire upper or lower base member add support and can be sewn laterally or diagonally for some embodiments.

Figure 12E:
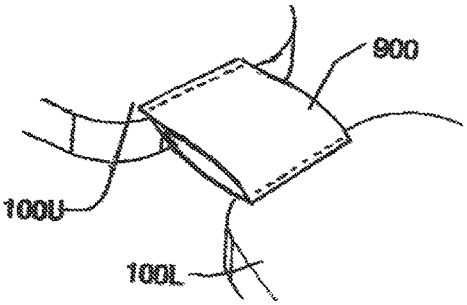

FIG. 12E shows an upper and lower base member attachment aperture 900 with the upper and lower edge of the attachment material sewn to the middle of the back edge of the lower base member 100L and the middle of the back edge of upper base member 100U. The upper and lower base member attachment aperture can be two pieces of material or one piece of material folded in half with an aperture formed by the separation of the unconnected/unsewn central portion of the material. It is contemplated that one or more adjacent upper and lower base member attachment apertures could be used for further support.

It is further contemplated that an upper and lower base member attachment would be sewn to the upper and lower base members in a similar fashion as the upper and lower base member attachment aperture is sewn as described in FIG. 12E.

Referring now to the connection methods of base apertures shown in FIGS. 12A-12E the showing is for describing aspects of connection methods of apertures to the base member of the portable exercise device only and not for the purpose of limiting the same.

Figure 13A:
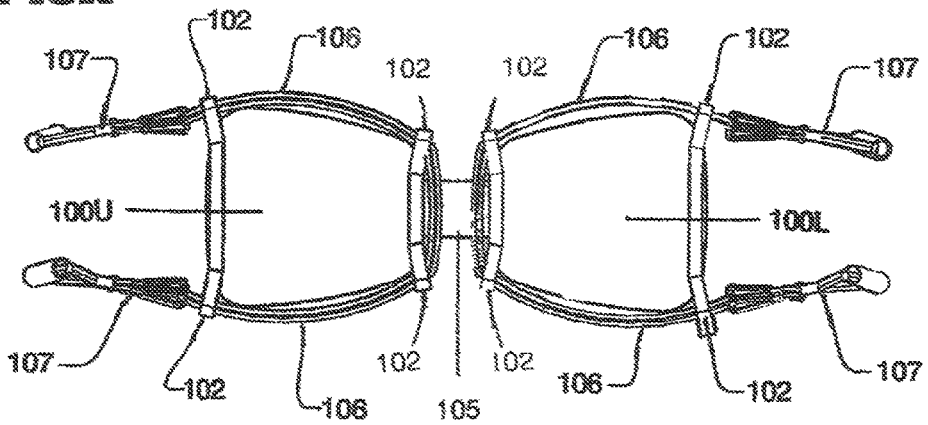
FIGS. 13A-13C are perspective views of various arrangements of base apertures including patterns of the threading of resistance members through the apertures.
Figure 13B:
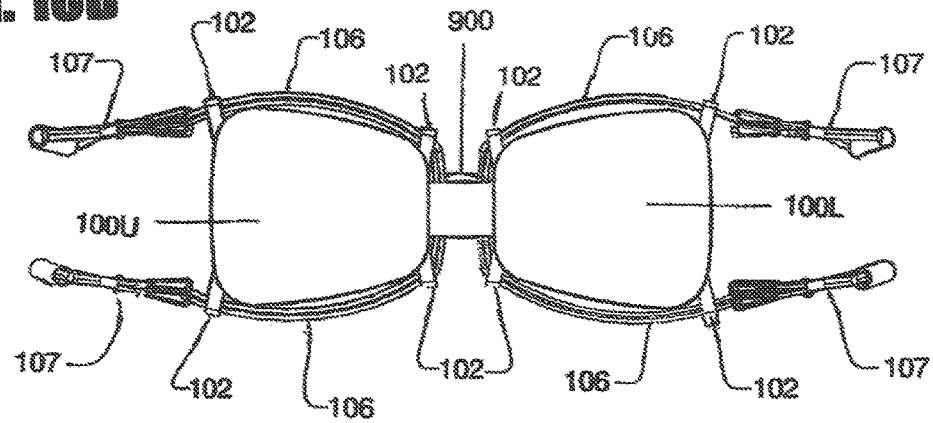
Figure 13C:
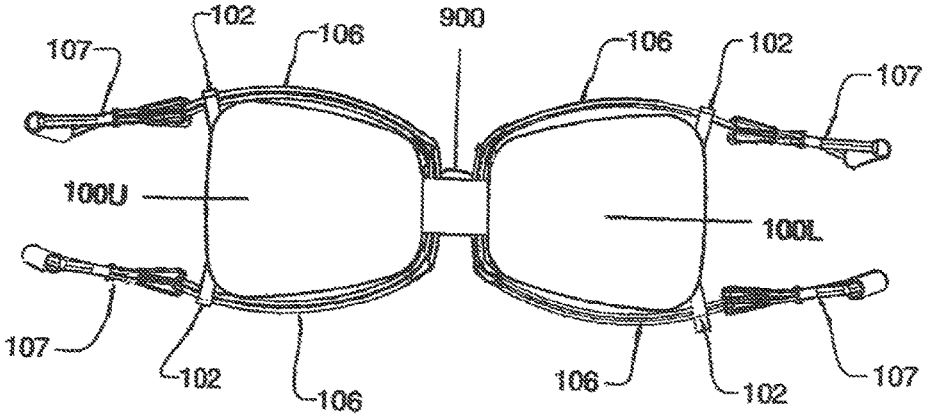

FIGS. 13A-13C are perspective views of various arrangements of base apertures including patterns of the threading of resistance members through the apertures.

FIG. 13A shows upper and lower base members 100U 100L with a plurality of base apertures 102 located outwardly of respective peripheral edges of the base members to facilitate exercises with resistance members 106; four base apertures are shown with the upper base member and four with the lower base member. Two sets of single resistance members are shown, one set for the upper base member and one set for the lower base member. One set of resistance members is threaded through the four base apertures of upper base member and one set is threaded through the four base apertures of the lower base member. The resistance members run along the peripheral edges of the upper and lower base members. Each set of resistance members includes two resistance members with each free end having a single resistance member gripping device 107. The upper and lower base members are attached with an upper and lower base member attachment 105.

FIG. 13B shows upper and lower base members 100U 100L with a plurality of base apertures 102 located outwardly of respective peripheral edges of the base members to facilitate exercises with resistance members 106; four base apertures are shown with the upper base member, four with the lower base member and an upper and lower base member attachment aperture 900 is shown attaching the upper and lower base members. Two sets of two resistance members are shown, one set for the upper base member and one set for the lower base member. One set of resistance members is threaded through the four base apertures of upper base member and one set is threaded through the four base apertures of the lower base member. Both sets are also threaded through the upper and lower base member attachment aperture. The resistance members run along the peripheral edges of the upper and lower base members. Each set of resistance members includes two resistance members with each free end having a single resistance member gripping device 107.

FIG. 13C shows upper and lower base members 100U 100L with a plurality of base apertures 102 located outwardly of respective peripheral edges of the base members to facilitate exercises with resistance members 106; two base apertures are shown with the upper base member, two with the lower base member and an upper and lower base member attachment aperture 900 is shown attaching the upper and lower base members. Two sets of two resistance members are shown, one set for the upper base member and one set for the lower base member. One set of single resistance members is threaded through the two base apertures of upper base member and one set is threaded through the two base apertures of the lower base member. Both sets are also threaded through the upper and lower base member attachment aperture. The resistance members run across a portion of the back of the upper and lower base members. Each set of resistance members includes two resistance members with each free end having a single resistance member gripping device 107.

Referring now to the various arrangements of base apertures including patterns of the threading of resistance members through the apertures shown in FIGS. 13A-13C the showing is for describing aspects of methods of threading resistance members through base apertures of the portable exercise device only and not for the purpose of limiting the same. Also referring to the locations of the base apertures shown in FIGS. 13A-13C the showing is for describing aspects of locations of the base apertures and not for the purpose of limiting the base aperture locations or the number of apertures used.

Figure 14A:
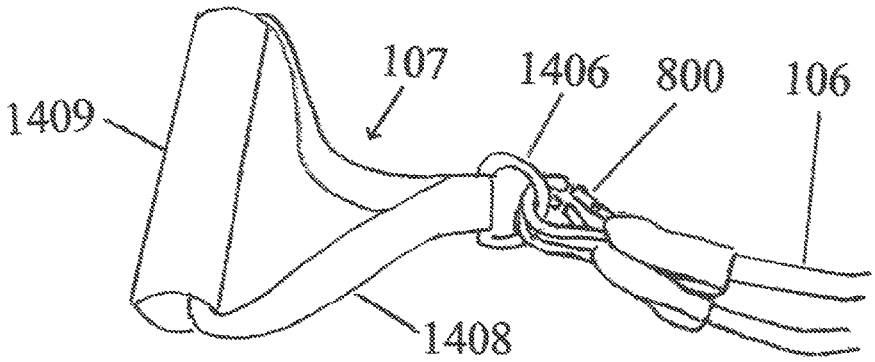
FIGS. 14A-14C are perspective views of various resistance members including connection methods to resistance member gripping devices.
Figure 14B:
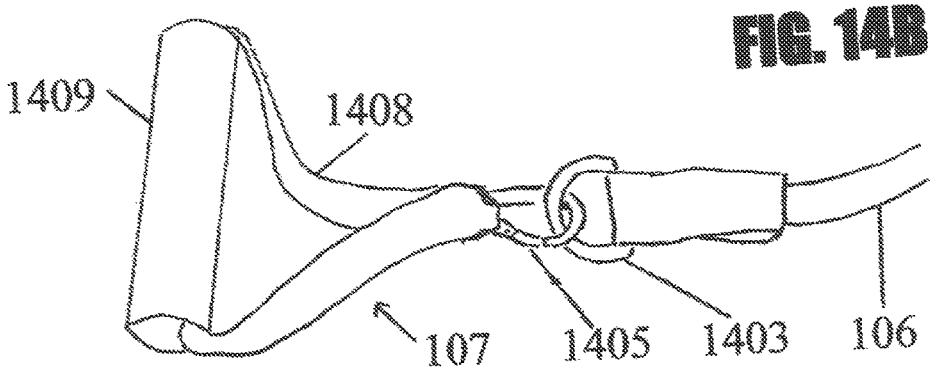
Figure 14C:
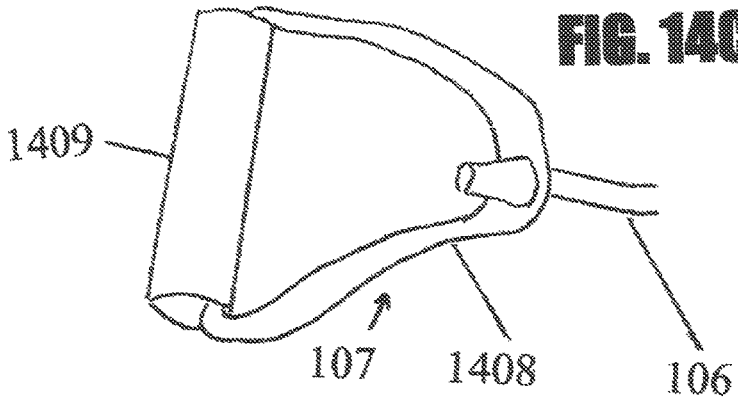

FIGS. 14A-14C show perspective views of various resistance members ends including connection to resistance member gripping devices.

FIG. 14A shows a perspective view of a plurality of resistance members 106 having resistance member attachment hooks 800 which are clipped on a resistance member gripping device attachment ring 1406. The resistance member gripping device 107 has a resistance member gripping device strap 1408 which goes through the resistance member gripping device tube 1409, is wrapped around the resistance member gripping device attachment ring and is sewn close to the gripping device attachment ring.

Both ends of the resistance members would be connected to a gripping device in the same manner. In some aspects of the portable exercise device one end of the resistance members would be connected with resistance member attachment hooks to a base aperture.

FIG. 14B shows a perspective view of a resistance member gripping device 107 having a resistance member gripping device attachment hook 1405 which is clipped on to a resistance member attachment ring 1403. The resistance member attachment ring in FIG. 14B has a strap connecting the attachment ring to a resistance member 106. A resistance member gripping device strap 1408 which goes through the resistance member gripping device tube 1409, is wrapped around the resistance member gripping device attachment hook and sewn close to the gripping device attachment hook. The resistance member gripping device attachment hook in FIG. 14B is a snap hook. The resistance member attachment ring is a "D" ring in FIG. 14B.

FIG. 14C shows a perspective view of resistance member 106 having a permanently attached resistance member gripping device 107. The resistance member gripping device consists of a resistance member gripping device tube 1409 and a resistance member gripping device strap 1408 with the flexibility for the straps and tube to be threaded through base apertures of the portable exercise device.

Referring now to the various resistance members including connection to resistance member gripping devices shown in FIGS. 14A-14C the showing is for the purpose of describing aspects of resistance members ends including connection methods to gripping devices of the portable exercise device only and not for the purpose of limiting the same.

Figure 15:
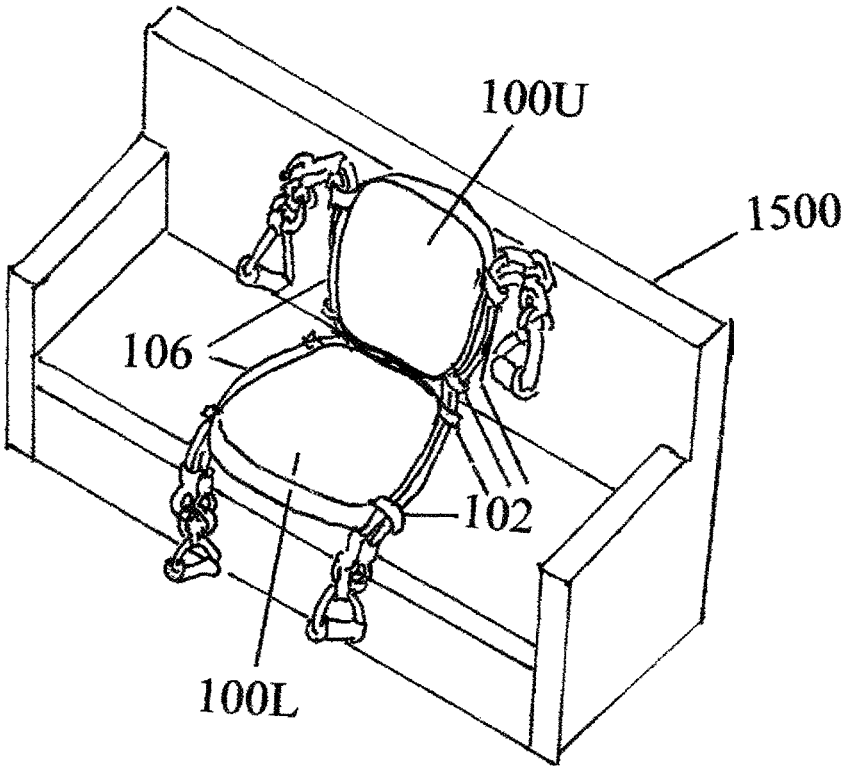
FIG. 15 is a perspective view of the portable exercise device arranged on a couch.

FIG. 15 shows a perspective view of one embodiment of the portable exercise device on a couch 1500.

As illustrated in FIG. 15 the portable exercise device includes an upper and a lower base member 100U 100L with a plurality of base apertures 102 located outwardly of respective peripheral edges of the base to facilitate resistance members 106 for exercise purposes. Four base apertures are shown as part of the upper base member and four as part of the lower base member.

Figure 16:
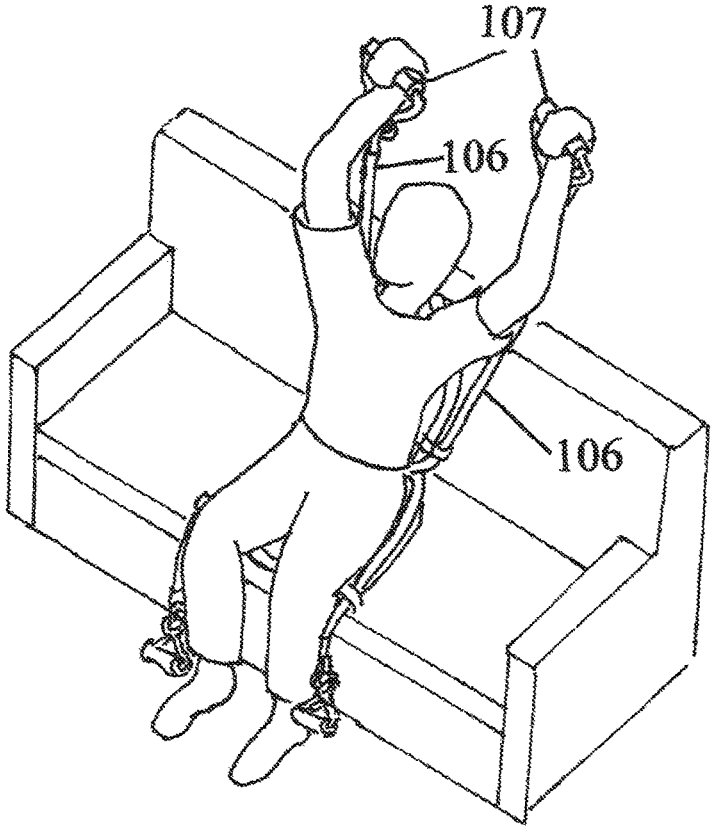
FIG. 16 is a perspective view of a user utilizing the portable exercise device of FIG. 15 arranged on a couch.

FIG. 16 shows a perspective view of a user sitting on top of the portable exercise device of FIG. 15. The user is holding the resistance member gripping devices 107 of the upper set of resistance members 106 as is in the case of a user stretching the resistance member for a military press exercise.

Figure 17:
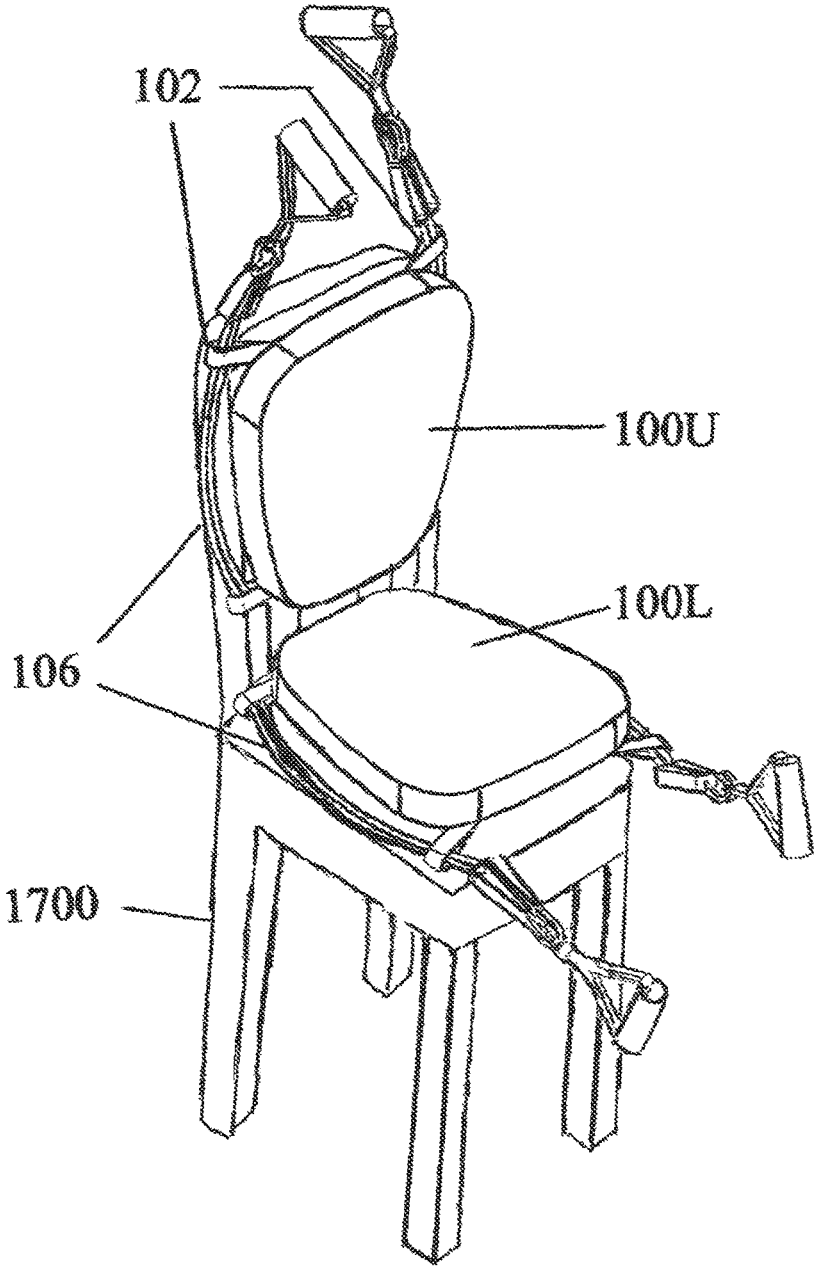
FIG. 17 is a perspective view of the portable exercise device arranged on a chair.

FIG. 17 shows a perspective view of one embodiment of the portable exercise device on a chair 1700.

As illustrated in FIG. 17 the portable exercise device includes an upper and a lower base member 100U 100L with a plurality of base apertures 102 located outwardly of respective peripheral edges of the base to facilitate resistance members 106 for exercise purposes. Three base apertures (one is hidden) are shown as part of the upper base member and three base apertures (one is hidden) as part of the lower base member.

Figure 18:
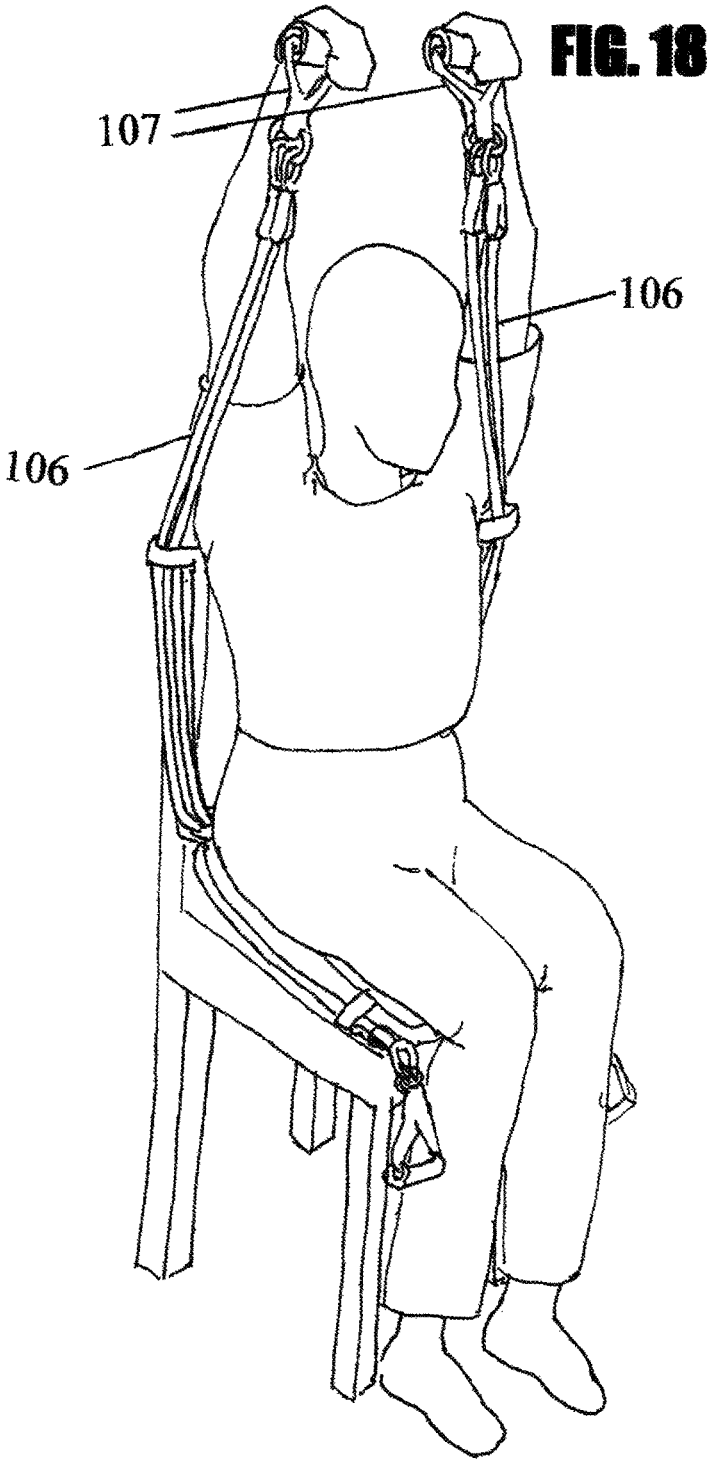
FIG. 18 is a perspective view of a user utilizing the portable exercise device of FIG. 17 arranged on chair.

FIG. 18 shows a perspective view of a user sitting on top of the portable exercise device of FIG. 17. The user is holding the resistance member gripping devices 107 of the upper set of resistance members 106 with the user's arms extended and resistance members stretched upwardly as is in the case of a user doing a military press exercise.

Figure 19:
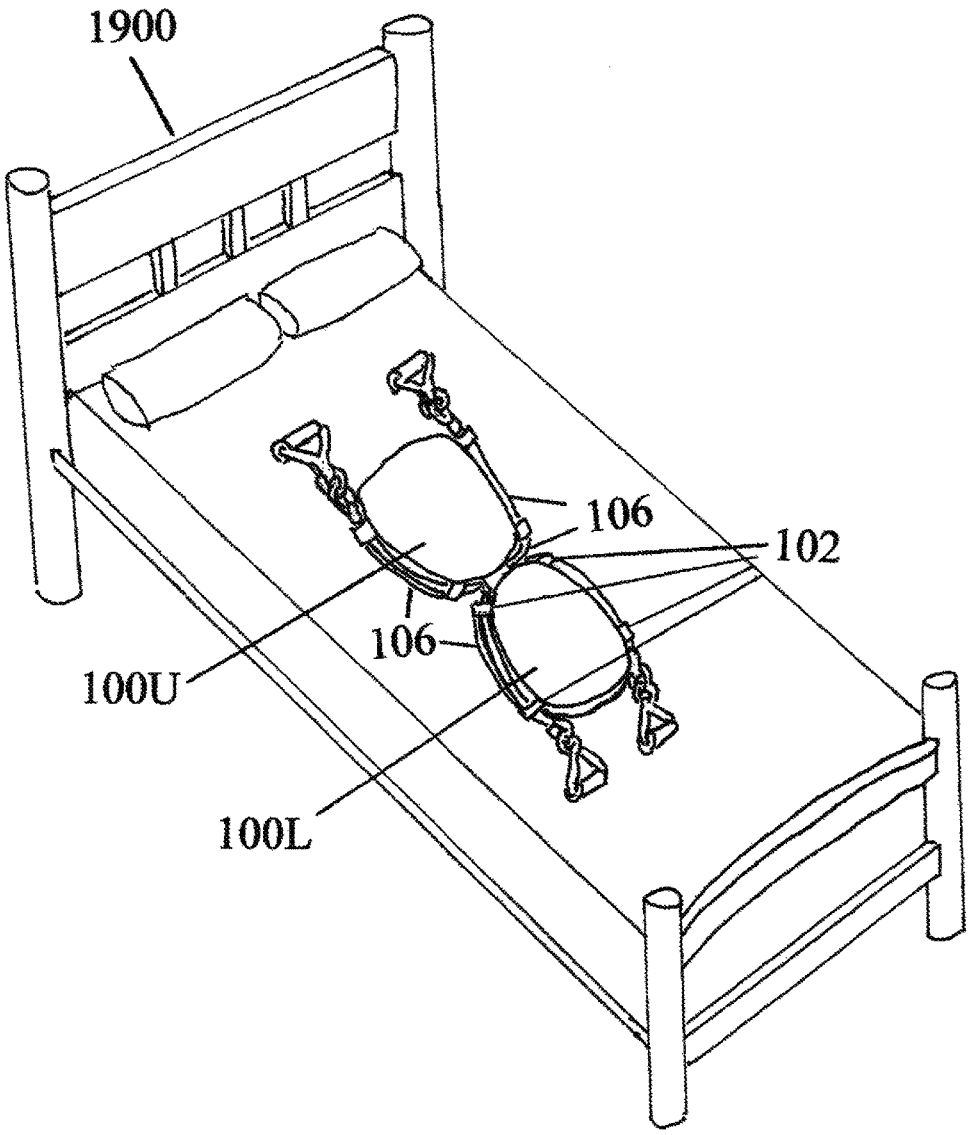
FIG. 19 is a perspective view of the portable exercise device arranged on a bed.

FIG. 19 shows a perspective view of one embodiment of the portable exercise device on a bed 1900.

As illustrated in FIG. 19 the portable exercise device includes an upper and a lower base member 100U 100L with a plurality of base apertures 102 located outwardly of respective peripheral edges of the base to facilitate resistance members 106 for exercise purposes. Four base apertures are shown as part of the upper base member and four as part of the lower base member.

Figure 20:
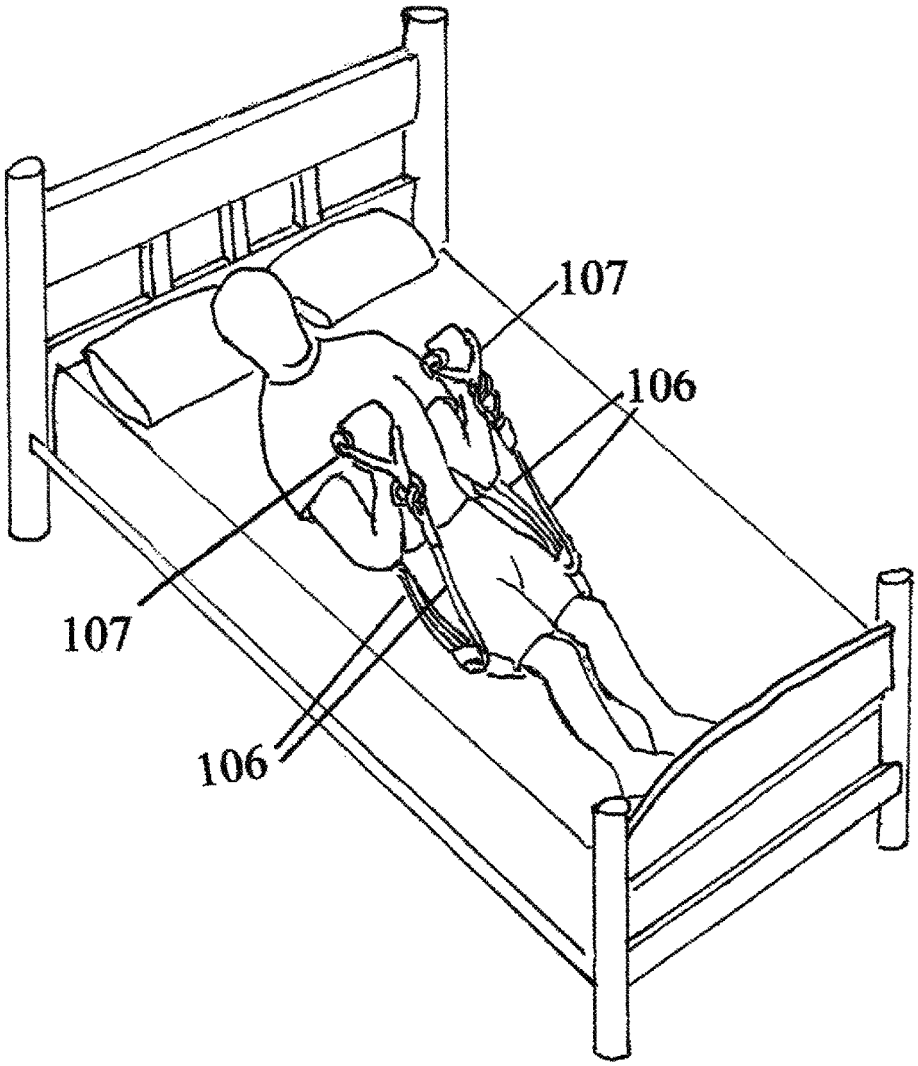
FIG. 20 is a perspective view of a person utilizing the portable exercise device of FIG. 19 arranged on bed.

FIG. 20 shows a perspective view of a user lying on top of the portable exercise device of FIG. 19. The user is holding the resistance member gripping devices 107 of the lower set of resistance members 106 as is in the case of a user stretching the resistance member for a bicep curl exercise.

It is contemplated that a user of the portable exercise device on a bed can have the user's lower legs off the bed and/or can lie across the bed while using the device.

Operation—FIGS. 21A-31B

The operation of the portable exercise device describes exercises that can be performed on all of the embodiments of the exercise device.

Figure 21A:
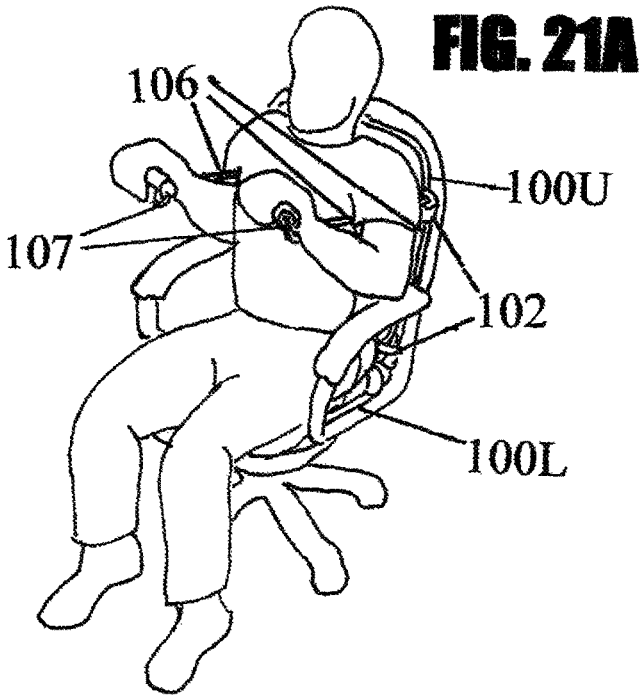
FIGS. 21A-21B are perspective views of a user of the portable exercise device performing a chest press exercise.
Figure 21B:
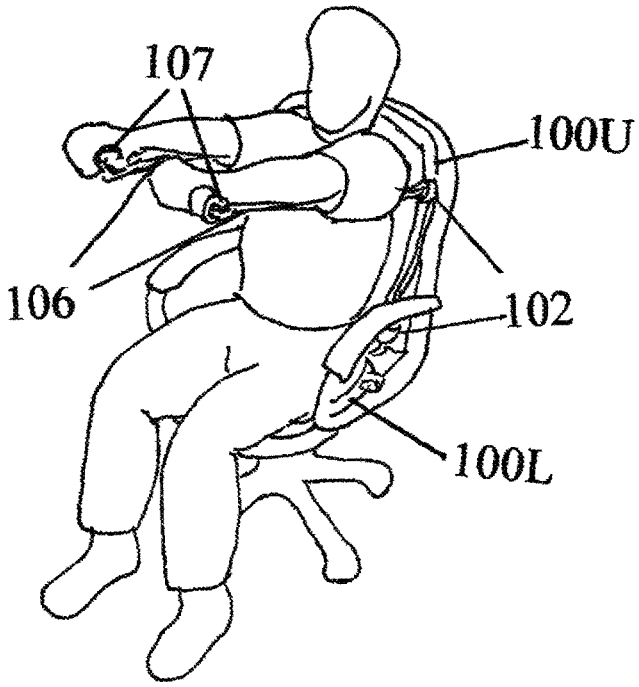

The user in FIGS. 21A and 21B is shown holding the upper resistance member gripping devices 107 in each hand, the gripping devices attached to one or more resistance members 106. The user starting with the hands close to the base apertures 102 at the top of the upper base member 100U and near the shoulders (FIG. 21A), extends the arms/hands forward (FIG. 21B) and thus stretches the resistance members primarily exercising the chest pectoral and triceps muscles. The user is sitting on top of the lower base member 100L and has his back against the upper base member.

The chest press exercise shown in FIGS. 21A and 21B is stretching the resistance members from the base apertures at the top of the upper base member to the end of the resistance members near the resistance member gripping device. The portion of the resistance member being stretched is due the tension/friction at the aperture at the top of the upper base member where the resistance member is stretched at a severe angle. The portion of the resistance member between the aperture at the top of the upper base member and the apertures at the lower end of the upper base member are minimally or not stretched.

The chest press exercise in FIGS. 21A and 21B shows an extension of arms and stretching of the resistance members at approximately 90 degree angle from the vertical portion of the resistance members parallel to the upper base member. Variations of this exercise can be done by altering the angle the arms are extended and resistance members are stretched. The common incline press exercise can be performed by the user extending the arms and stretching the resistance members at approximately a 135 degree angle. A similar variation of the chest press exercise of FIGS. 21A and 21B is for the user to extend the arms and stretch the resistance members at less than a 90 degree angle, It is a known fact that the repetition of the exact exercise will tend to lose some of its benefit over time, the variations of the chest press exercises provide the user valuable options to an upper body workout routine, options that can assist in continuing long term muscle growth and strengthening.

These chest press exercises and their variations can be performed with the resistance members placed between the upper arm and torso of the body as shown in FIGS. 21A and 21B or with the resistance members outside of the upper arm providing some additional resistance.

Figure 22A:
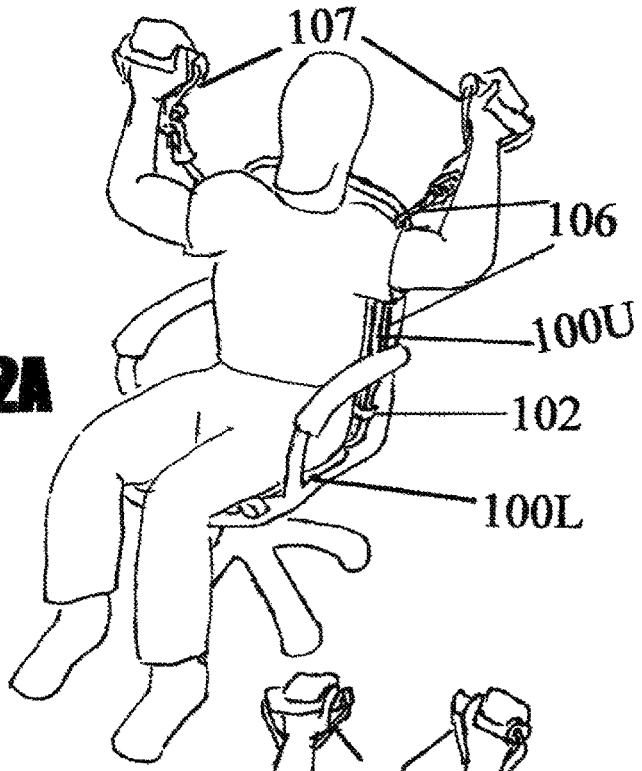
FIGS. 22A-22B are perspective views of a user of the portable exercise device performing a military or shoulder press exercise.
Figure 22B:
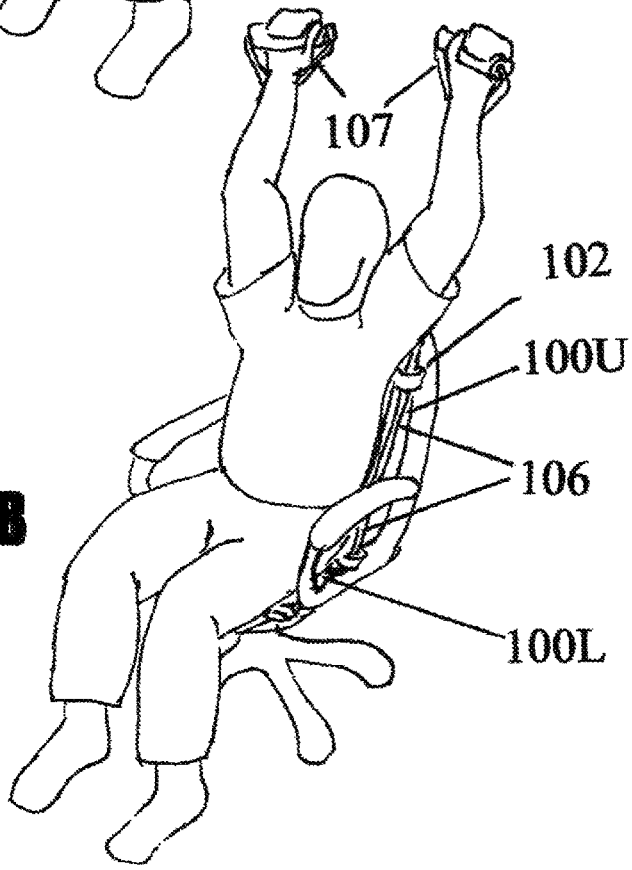

The user in FIGS. 22A and 22B is shown holding the upper resistance member gripping devices 107 in each hand, the gripping devices attached to one or more resistance members 106. The user starting with the hands close to the base apertures 102 at the top of the upper base member 100U and near the shoulders extends the arms/hands upward and thus stretches the resistance members primarily exercising the shoulder deltoid muscles. The user is sitting on top of the lower base member 100L and has his back against the upper base member.

The shoulder press exercise shown in FIGS. 22A and 22B is stretching the resistance members not from the base apertures at the top of the upper base member, like in the chest press of FIGS. 21A and 21B, but from the apertures at bottom of the upper base member to the end of the resistance members where connected to the gripping devices.

The portion of the resistance members being stretched in FIGS. 22A and 22B is longer than with the chest press exercise shown in FIGS. 21A and 21B due to minimal tension/friction at the aperture at the top of the upper base member where the resistance member is stretched at a minimal angle or approximately a 180 degree angle. The resistance members in the shoulder press exercise of FIGS. 22A and 22B are able to slide through the base apertures at the top of the upper base member when stretched.

Figure 23A:
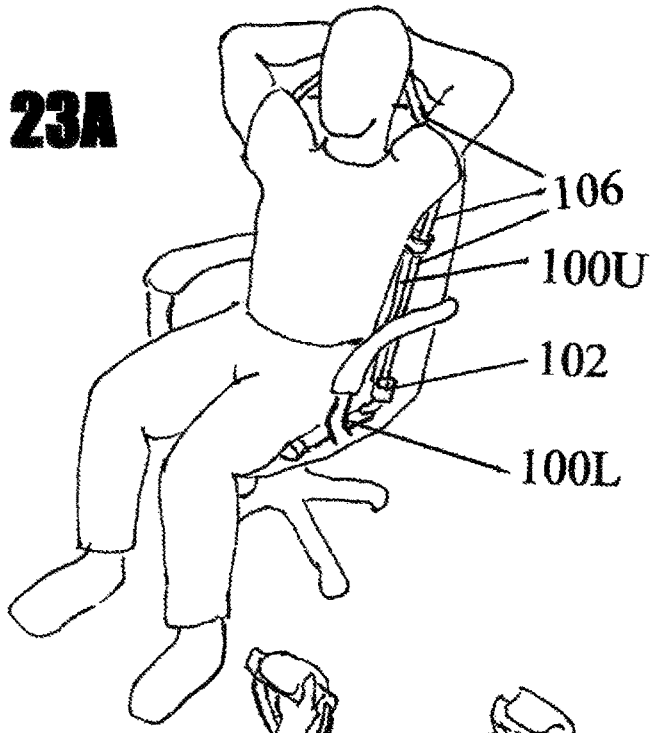
FIGS. 23A-23B are perspective views of a user of the portable exercise device performing an overhead triceps extension exercise.
Figure 23B:
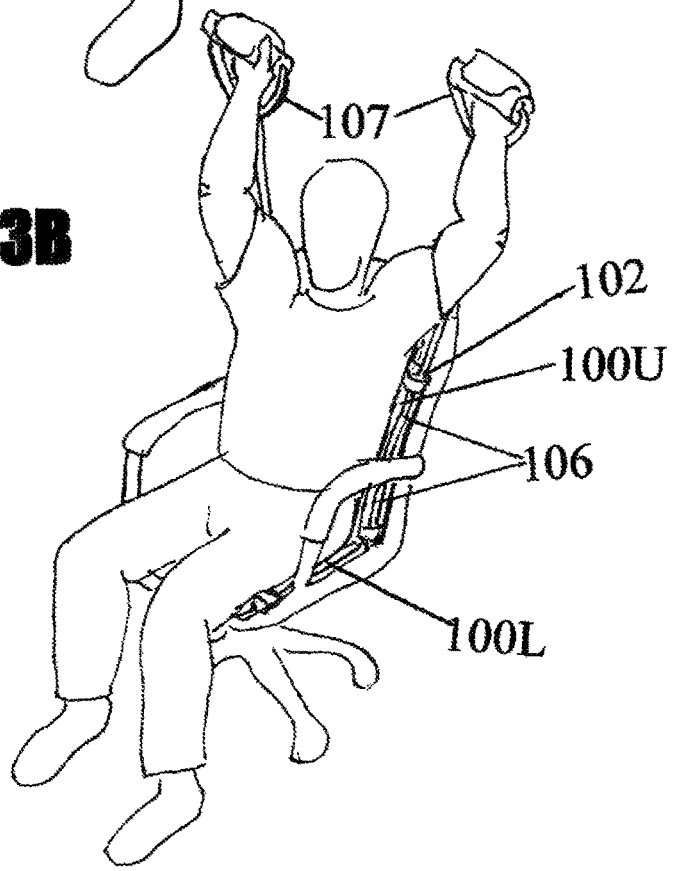

The user in FIGS. 23A and 23B is shown holding the upper resistance member gripping devices 107 in each hand (resistance member gripping devices are hidden from view in FIG. 23A), the gripping devices attached to one or more resistance members 106. The user starting with the hands close to the base apertures 102 at the top of the upper base member 100U and near the shoulders and with the elbows pointing forward and upward, extends the arms/hands upward stretching the resistance members and primarily exercising the arm triceps muscles. The user is sitting on top of the lower base member 100L and has his back against the upper base member.

The overhead triceps extension exercise shown in FIGS. 23A and 23B is stretching the resistance members not from the base apertures at the top of the upper base member, like in the chess press of FIGS. 21A and 21B, but from the apertures at bottom of the upper base member to the end of the resistance members where connected to the gripping devices.

The portion of the resistance member being stretched in FIGS. 23A and 23B is longer than with the chest press exercise shown in FIGS. 21A and 21B due to minimal tension/friction at the base aperture at the top of the upper base member where the resistance member is stretched at a minimal angle or approximately an 180 degree angle. The resistance member in triceps extension exercise of FIGS. 23A and 23B is able to slide through the apertures at the top of the upper base member when stretched.

Figure 24A:
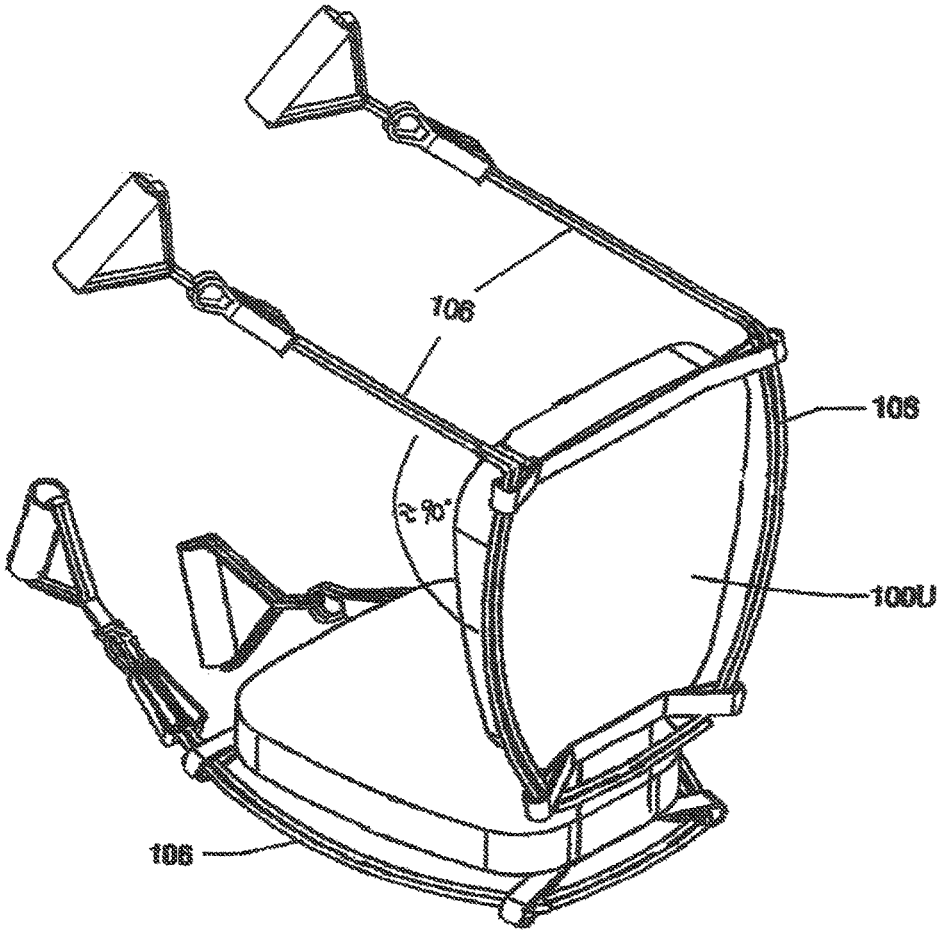
FIGS. 24A-24B are perspective views of the portable exercise device showing the resistance difference when stretching the resistance member at different angles (outward verses upward).

FIG. 24A shows a perspective view of the portable exercise device with the extension and stretching of the resistance members 106 at approximately a 90 degree angle from the vertical portion of the resistance members parallel to and adjacent to the upper base member 100U.

Figure 24B:
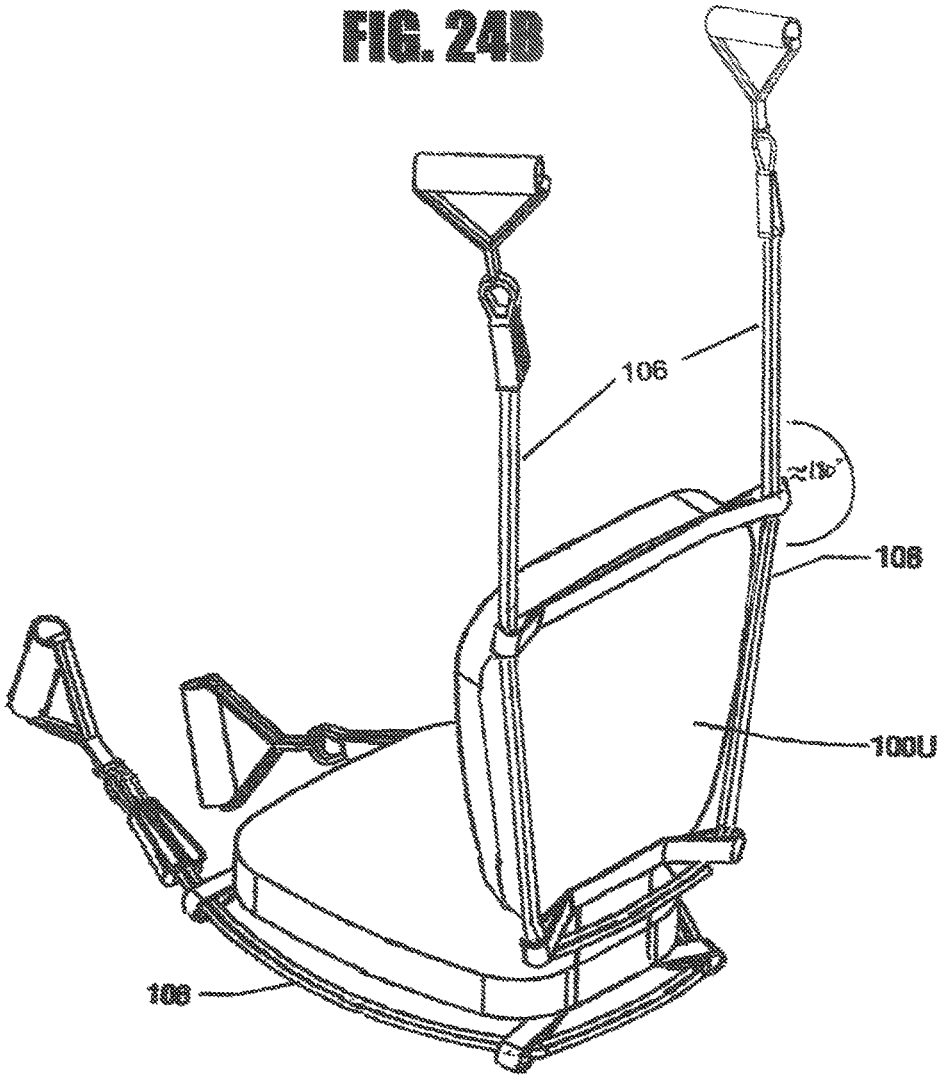

FIG. 24B shows a perspective view of the portable exercise device with the extension and stretching of the resistance members 106 at approximately a 180 degree angle from the vertical portion of the resistance members parallel to and adjacent to the upper base member 100U.

The resistance exercise when performed with the extension and stretching of the resistance members at approximately a 90 degree angle provides greater resistance verses extension and stretching of the resistance members at approximately a 180 degree angle.

The resistance difference is due to when the resistance members are extended at an approximately a 90 degree angle, the tension/friction at the base aperture where the resistance members direction is changed sharply causes only the portion of the resistance members from the base aperture outward to be stretched. When the resistance members are extended at an approximately a 180 degree angle, the tension/friction at the base aperture is minimal and both the portion of the resistance members from the base aperture upward and the portion below the base aperture are stretched. The resistance members are able to slide through the base aperture when there is minimal angle change at the base aperture.

The resistance difference shown in FIGS. 24A and 24B and described above is conducive to the chest press exercise (pushing outward at an approximately a 90 degree angle) shown in FIGS. 21A and 21B which requires more resistance by a typical user to be effective and the shoulder press exercise shown in FIGS. 22A and 22B and the overhead triceps extension exercise shown in FIGS. 23A and 23B (pushing upward at an approximately a 180 degree angle) which require less resistance to be effective. Using the portable exercise device with the two types of exercises (outward approximately 90 degree angle and upward approximately 180 degree angle) the user can use the same resistance members, from the same resistance members starting position, with significantly different resistance.

A longer length of a resistance member, when stretched for an equivalent distance as a shorter length of a resistance member, has less resistance. For example it is easier, less resistance, to stretch a 609 mm (two feet) elastic tube 152 mm (six inches) than it is to stretch a 305 mm (one foot) elastic tube 152 mm (six inches).

The ability to use the same resistance members, with different resistance levels based on the angle the resistance member is stretched, for different exercises requiring different levels of resistance adds convenience and ease of use for the user and is an advantage over exercise devices of the prior art.

The resistance difference when the resistance members are extended at an approximately a 90 degree angle verses when the resistance members are extended at an approximately 180 degree angle is based on the resistance member either stretching or sliding through the base aperture (180 degree angle) or being fixed at the point of the base aperture (90 degree angle).

The resistance members when stretched or extended at approximately a 90 degree angle, which the majority of exercises with the portable exercise device do, are only stretched from the closest base aperture to the resistance member gripping device. This contributes to the ability to do one hand at a time or two hands gripping the same handle exercises without the resistance member being displaced.

When the user is going to perform an exercise where the resistance members are extended at an approximately 90 degree angle (the resistance member is fixed at the point of the base aperture) the resistance can be adjusted by pulling or sliding an additional length of the resistance members beyond the closest base aperture prior to starting the exercise. The adjustment where an additional resistance member length is beyond the closest base aperture to the resistance member gripping device decreases the resistance when performing the exercise.

Additionally the resistance member length from the closest base aperture to the resistance member gripping device can be shortened by pulling or sliding an additional portion of the resistance member not beyond the closest base aperture to the resistance member gripping device but to the other side of the base aperture where the resistance member is fixed or not stretched. This adjustment shortening the resistance member length beyond the outer base aperture when performing exercises that stretch the resistance members at a sharp angle (approximately 90 degrees or more) increases the resistance when performing the exercise.

Increasing the length of the resistance member from the closest base aperture to the resistance member gripping device (decreasing resistance) can be done by simply pulling on the resistance member gripping devices at an approximately 180 degree angle to slide more of the resistance member beyond the base aperture prior to starting the exercise.

Decreasing the length of the resistance member from the closest base aperture to the resistance member gripping device (increasing resistance) can be done by simply pulling the resistance member through the base aperture and away from gripping device by hand prior to starting the exercise.

The ability to adjust the resistance of the resistance member for an exercise by adjusting the length of the resistance member to either side of the closest base aperture to the resistance member gripping device is an advantage of the present invention over exercise devices of the prior art.

None of the exercise devices of the prior art include the threading of resistance member through base apertures but many instead have simply attachment of one end to the device and thus don't have the resistance difference based on extension angle and the resistance adjustment advantages described above.

Referring now to the exercises described with FIGS. 21A-23B which all use the upper set of resistance members threaded through base apertures of the upper base member.

Although the exercises described with FIGS. 21A-23B perform valuable chest, arm and shoulder exercises, there are several other exercises that can be performed which use the upper set of resistance members threaded through base apertures of the upper base member; a shoulder shrug exercise can be performed by the user by holding the resistance gripping devices of the upper set of resistance members with arms extended forward and slightly downward and then raising and lowering the shoulders, a chest or pectoral muscle fly can be done by the user holding the gripping devices of the upper set of resistance members and with the resistance members around the outside of the arms, keeping the elbows at a constant angle, starting with the hands and arms outward and to the side moving the hands and arms in an arc to the front of the chest, a forward triceps extension similar to the overhead triceps extension, as well as abdominal exercises described in FIGS. 28A-28B.

It is contemplated that additional exercises of the present invention using the upper set of resistance members can be performed.

Figure 25A:
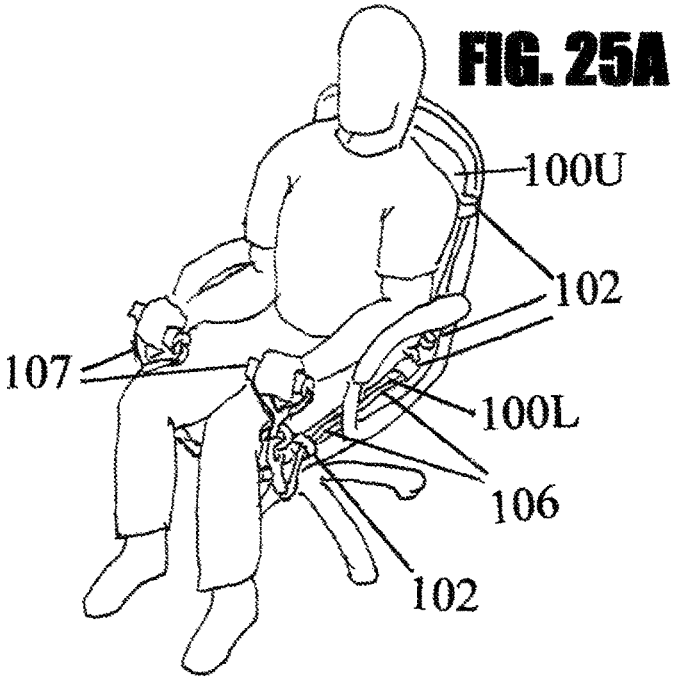
FIGS. 25A-25B are perspective views of a user of the portable exercise device performing a bicep curl exercise.
Figure 25B:
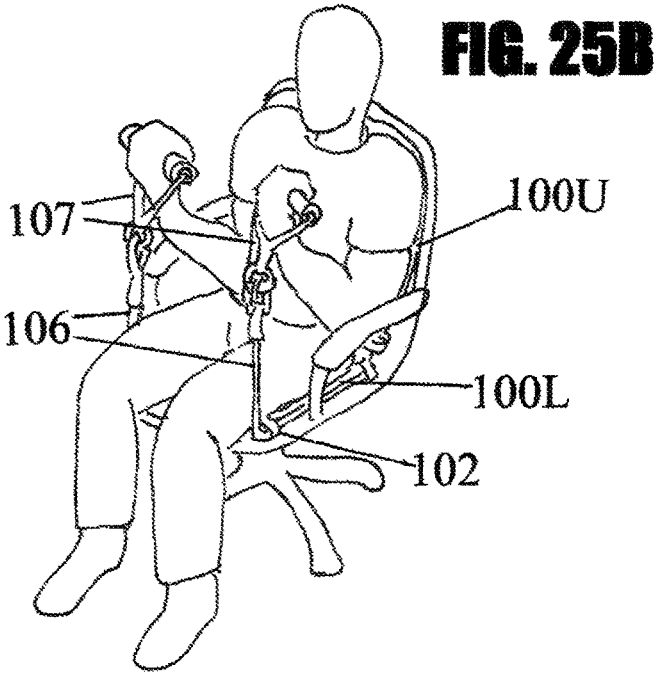

The user in FIGS. 25A and 25B is shown holding the lower resistance members gripping devices 107 in each hand, the gripping devices attached to one or more resistance members 106. The user starting with the hands close to the base apertures 102 at the end of the lower base member 100L, palms upward, and near the knees and pulls the arms/hands upward and toward the shoulders and thus stretches the resistance members and primarily exercising the arm bicep muscles. The user is sitting on top of the lower base member and has his back against the upper base member 100U.

The bicep curl exercise shown in FIGS. 25A and 25B is stretching the resistance members from the base apertures at the end of the lower base member, near the user's knees, to the end of the resistance members where connected to the resistance member gripping device. The portion of the resistance member being stretched is due the tension/friction at the base aperture at the front end of the lower base member where the resistance member is stretched at a severe angle. The portion of the resistance members between the base apertures at the front end of the lower base member and the base apertures at the back/opposite end of the lower base member are minimally or not stretched.

The bicep curl exercise shown in FIGS. 25A and 25B shows a standard bicep curl, variations of the bicep curl exercise can easily be done with the palms facing downward to perform a common reverse bicep curl exercise and with the palms facing inward to perform a common hammer bicep curl exercise.

Additional variations of this exercise can be done by using one arm/hand at a time and/or altering the angle the arms are drawn toward the body; directly toward the shoulders, toward the center of the chest or outward of the shoulders.

It is a known fact that the repetition of the exact exercise will tend to lose some of its benefit over time, the variations of the bicep curl exercises provide the user valuable options to an upper arm workout routine, options that can assist in continuing long term muscle growth and strengthening.

Figure 26A:
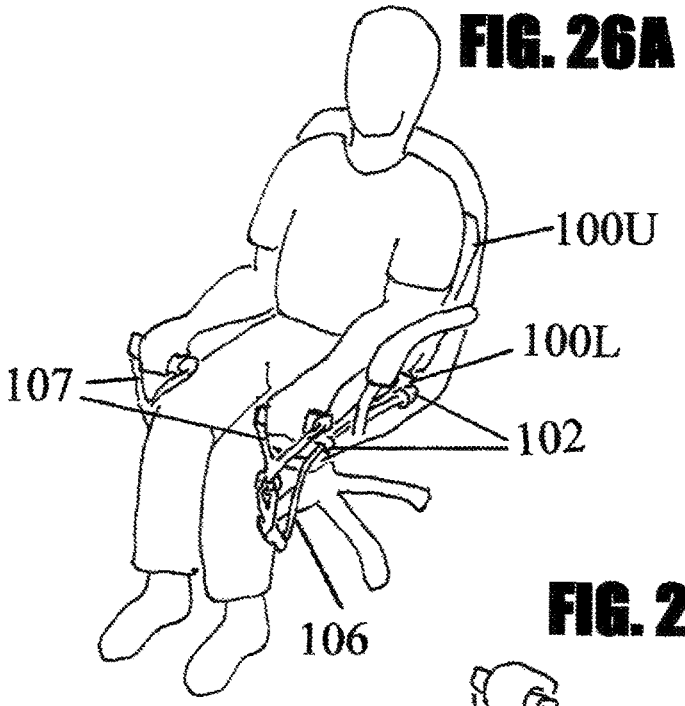
FIGS. 26A-26B are perspective views of a user of the portable exercise device performing a shoulder raise exercise.
Figure 26B:
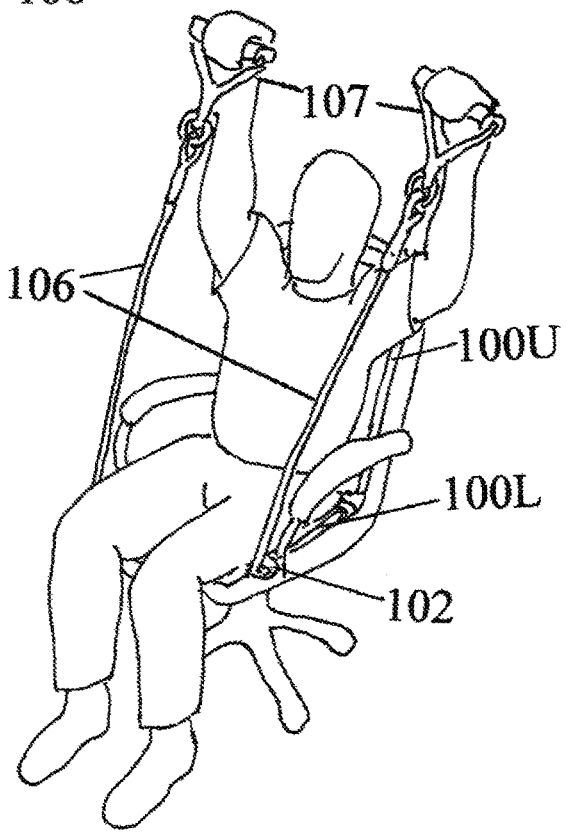

The user in FIGS. 26A and 26B is shown holding the lower resistance members gripping devices 107 in each hand, the gripping devices attached to one or more resistance members 106. The user starting with the hands close to the base apertures 102 at the end of the lower base member 100L, palms downward, and near the knees, rotates the arms/hands upward, keeping the arms relatively straight, thus stretching the resistance members and primarily exercising the shoulder deltoid muscles. The user is sitting on top of the lower base member and has his back against the upper base member 100U.

Variations of the shoulder lateral raise exercise shown in FIGS. 26A and 26B can be done by extending the arms/ hands upward and toward the side from the starting position (near the knees) and by using one arm/hand at a time.

The shoulder lateral raise exercise shown in FIGS. 26A and 26B is stretching the resistance members from the base apertures at the end of the lower base member, near the user's knees, to the end of the resistance members where connected to the resistance member gripping device. The resistance required for the shoulder lateral raise exercise shown in FIGS. 26A and 26B is typically less than what would be required by a bicep curl exercise as shown in FIGS. 25A and 25B. The reduction in resistance (level) using the portable exercise device can be accomplished by simply detaching one or more resistance members from the resistance member gripping device or by using a resistance member of lighter resistance for performing the exercise.

Figure 27A:
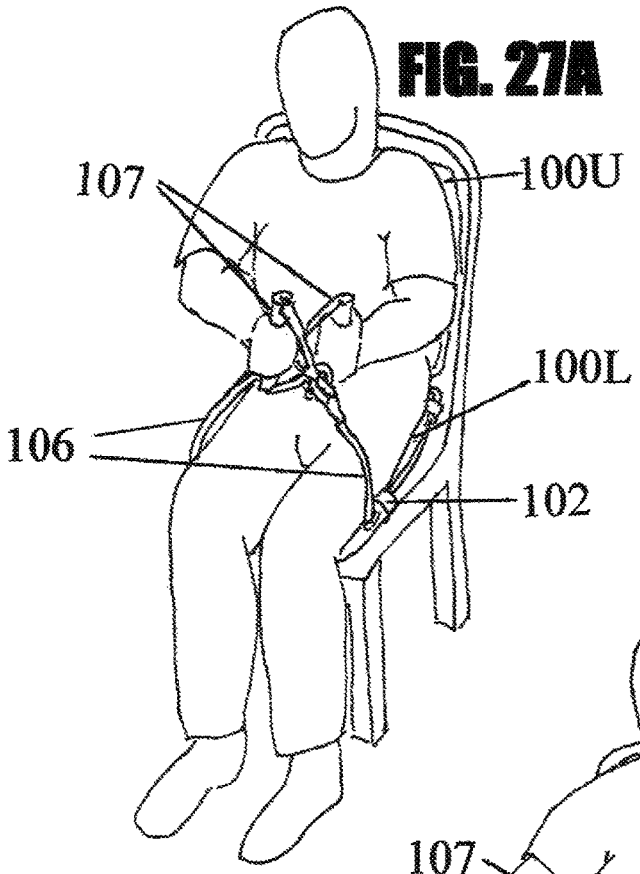
FIGS. 27A-27B are perspective views of a user of the portable exercise device performing a row exercise.
Figure 27B:
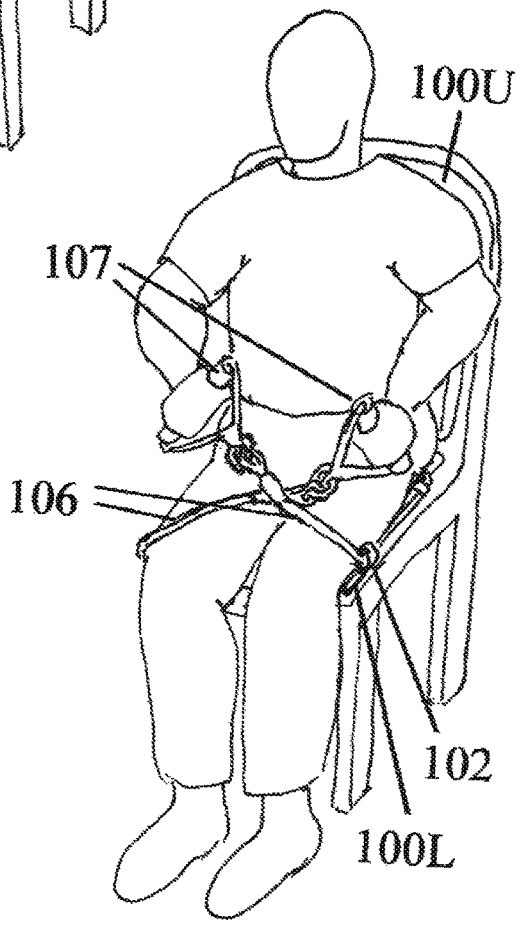

The user in FIGS. 27A and 27B is shown holding the lower resistance members gripping devices 107 in each hand, the gripping devices attached to one or more resistance members 106. The user starts with the hands above and between the base apertures 102 at the end of the lower base member 100L. For this exercise the right hand is holding the gripping device near the outside of the left knee and the left hand is holding the handle near the outside of the right knee. Starting with arms extended palms downward and the hands near the knees, the user pulls the arms/hands across the lower body toward the side of the chest and elbows past the chest, thus stretching the resistance members and primarily exercising the back latissimus dorsi muscles. The user is sitting on top of the lower base member and has his back against the upper base member 100U.

The row exercise shown in FIGS. 27A and 27B is stretching the resistance members from the base apertures at the end of the lower base member, near the user's knees, to the end of the resistance members where attached to the resistance member gripping device. The crossing of the hands to grip the opposite gripping devices is not required, but allows for a further length of resistance members stretching and therefore further muscle contraction.

Although the exercises described with FIGS. 25A-27B perform valuable back, arm and shoulder exercises, there are several other exercises which use the lower set of resistance members threaded through base apertures of the lower base member; a wrist curl and reverse wrist curl forearm exercises can be performed by the user by holding the gripping devices of the lower set of resistance members with arms extended forward and slightly upward, wrists facing up or down and then raising and lowering the wrists, a upright row can be done by the user holding the gripping devices of the lower set of resistance members, lifting the hands upward toward the chin and with the elbows outward.

It is contemplated that additional exercises of the present invention using the lower set of resistance members can be performed.

Referring now to the exercises shown in FIGS. 21A-27B the showing is for the purpose of illustrating possible exercises performed by the user using two hands/arms it is also possible to do all of these exercises and others contemplated using one hand/arm at a time.

Many of the exercises shown would be difficult or awkward with free or bar weights, but similar to exercise machines or cable machines can be performed with the portable exercise device using resistance members more comfortably or with greater ease of use. The portable exercise device has an advantage over the exercise or cable machines in that the user can perform all exercises from the same position or location and not have to move from one machine to another.

The user in FIGS. 28A and 28B is shown holding the upper resistance members gripping devices 107 in each hand, the gripping devices attached to one or more resistance members 106, with the resistance members placed over the shoulders of a user, starting with the hands close to the upper chest and with the hands remaining stationary the shoulders are rotated in a forward and downward motion, thus stretching the resistance members and primarily exercising the abdominal muscles of the user. The user is sitting on top of the lower base member and has his back against the upper base member 100U.

The abdominal crunch exercise shown in FIGS. 28A and 28B is stretching the resistance members from the base apertures 102 at the top of the upper base member to the shoulder area where the resistance members remain fixed.

A variation of the abdominal crunch exercise shown in FIGS. 28A and 28B can be done by rotating the shoulders when moving forward and downward to the left and right primarily exercising the abdominal oblique muscles of the user. The user would start the abdominal oblique crunch exercise with the shoulders upright, then rotate the shoulders forward, downward and to the left, return to the upright starting position, then rotate the shoulders forward, downward and to the right and then return to the starting upright position. And repeat.

When the user performs the oblique exercise as described, turning to the shoulders to the left, the right portion of the resistance member is stretched further than the left portion of the resistance member which may not be stretched at all and vice versa.

With abdominal crunch exercise shown in FIGS. 28A and 28B and the oblique crunch exercise described as well as the chest pectoral fly exercise previously described and other possible exercises the resistance members are positioned across the shoulders or arms altering or adjusting the length of the resistance members are stretched. The length of the resistance member stretched is not from a base aperture to the resistance member gripping device but from a base aperture to the spot where the resistance member is fixed to the body part; shoulder or arm.

The ability to use the resistance members positioned across or against a body part to alter or adjust the resistance for an exercise is an advantage of the exercise device not found (described) with exercises devices of the prior art.

Another variation of the abdominal crunch exercise shown in FIGS. 28A and 28B can be done by the user holding the resistance member gripping devices of the lower resistance members near the base apertures of the lower base member and near the chest, and starting with the upper body bent over, rotating the shoulders and chest upward toward an upright position and thus stretching the resistance member primarily upward. The exercise described being a reverse abdominal crunch and primarily exercising the abdominal muscles of the user. The user can also twist his body during the reverse abdominal crunch to impact the oblique muscles.

It is a known fact that the repetition of the exact exercise will tend to lose some of its benefit over time, the variations of the abdominal exercises provide the user valuable options to an abdominal workout routine, options that can assist in continuing long term muscle growth and strengthening.

Figure 29A:
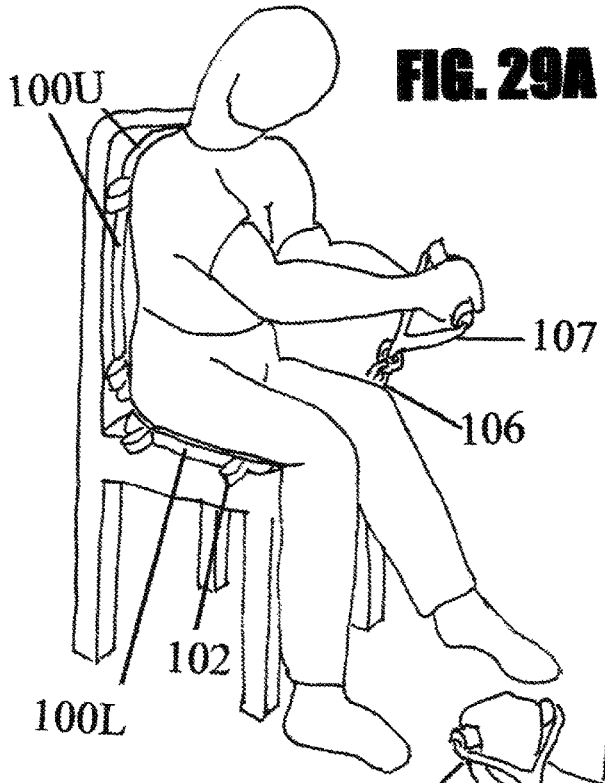
FIGS. 29A-29B are perspective views of a user of the portable exercise device performing a cross lateral raise exercise holding one resistance member gripping device with both hands.
Figure 29B:
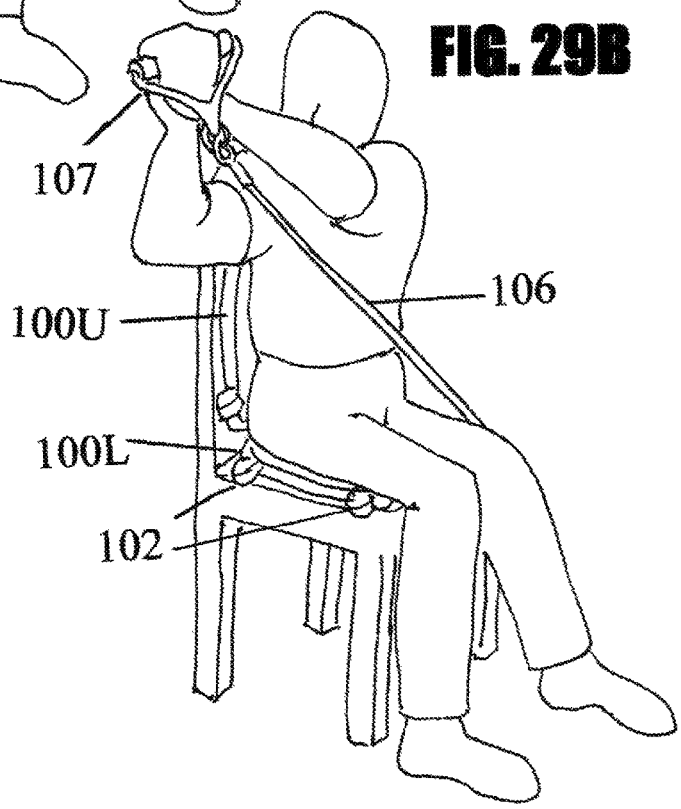

The user in FIGS. 29A and 29B is shown holding the left lower resistance members gripping device 107 with both hands, the gripping device attached to one or more resistance members 106, starting with both hands close to the base aperture 102 (left lower base aperture is hidden from view) at the left end of the lower base member 100L, and near the knees. The user pulls the arms/hands upward and across the body, thus stretching the resistance members and primarily exercising the shoulder, oblique and abdominal muscles. The user is sitting on top of the lower base member and has his back against the upper base member 100U.

In the cross lateral raise exercise shown in FIGS. 29A and 29B the user is stretching the resistance members from the base apertures at the left end of the lower base member to the end of the resistance members where attached to the resistance member gripping device. The cross lateral raise exercise shown in FIGS. 29A and 29B can be performed by holding the right lower gripping device with both hands and pulling upward and across the body and similarly holding the upper gripping device at either side with both hands and pulling downward and across the body.

The cross lateral raise exercise shown in FIGS. 29A and 29B and similar exercises described using two hands on one handle, the other handle not gripped, show the diversity of the portable exercise device and the exercises the user is capable of performing using the device.

The exercises with two hands on one handle without the displacement or sliding of the resistance members near the other resistance member gripping device is accomplished by the fact that the resistance member is only stretched from the nearest base aperture when stretched at a sharp angle and the entire resistance member is not stretched.

Figure 30A:
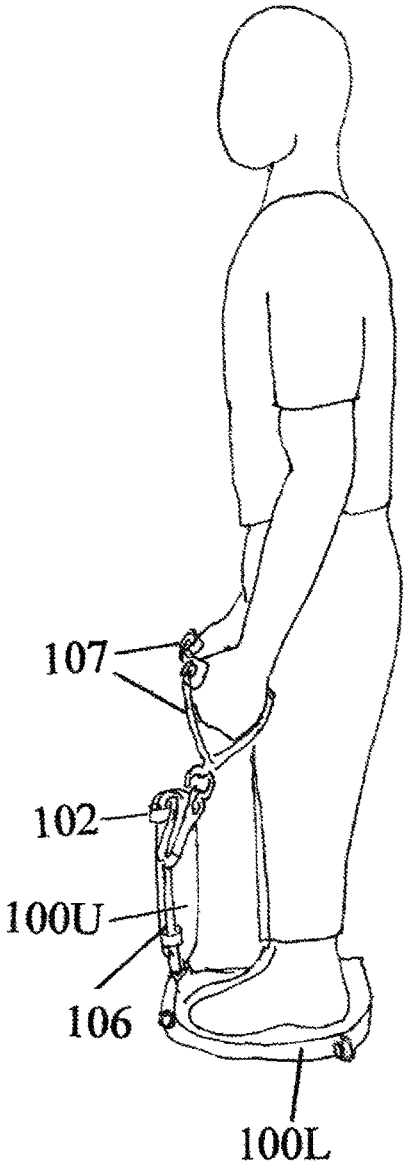
FIGS. 30A-30B are perspective views of a user of the portable exercise device performing a bicep curl exercise in a standing position.
Figure 30B:
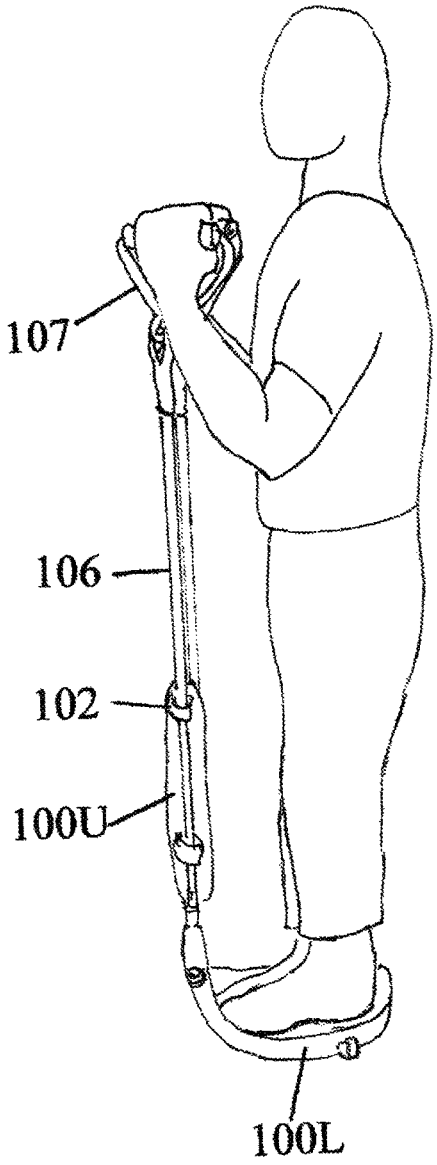

The user in FIGS. 30A and 30B is shown in a standing upright position holding the upper resistance member gripping devices 107 in each hand and standing with feet on the lower base member 100L for stability and comfort of the feet. Starting with the hands hanging straight, toward the floor and close to the upper base apertures 102 of the upper base member 100U, the user is pulling the arms/hands upward and toward the shoulders, stretching the resistance member 106 and exercising the arm bicep muscles.

The bicep curl exercise shown in FIGS. 30A and 30B is stretching the resistance members from the base apertures at the low end of the upper base member to the end of the resistance members where connected to the resistance member gripping device. The portion of the resistance member being stretched is due the minimal tension/friction at the base aperture at the top end of the upper base member where the resistance member slides through the base aperture.

The bicep curl exercise shown in FIGS. 30A and 30B shows a standard bicep curl, a variation of the bicep curl exercise can easily be done with the palms facing downward to perform a common reverse bicep curl exercise.

Additional variations of the bicep curl exercise can be done by using one arm/hand at a time and/or altering the angle the arms are drawn toward the body; directly toward the shoulders, toward the center of the chest or outward of the shoulders.

Although the exercises in FIGS. 30A-30B describe valuable bicep exercises, there are several other exercises that can be performed which use the portable exercise device while the user is in a similar standing position; a shoulder shrug exercise holding the resistance gripping devices of the upper set of resistance members with arms extended downward and then raising and lowering the shoulders, a wrist curl and reverse wrist curl forearm exercises by holding the resistance member gripping devices of the upper set of resistance members with arms extended forward, wrists facing up or down and then raising and lowering the wrists, a military press exercise by holding the resistance member gripping devices of the upper set of resistance members near the shoulders and stretching the resistance members upward overhead and an overhead triceps press exercise by holding the resistance member gripping devices of the upper set of resistance members near the shoulders, elbows forward and stretching the resistance members upward overhead.

Several other exercises can be performed while the user is in a standing position with feet on the lower base member where the user uses the lower set of resistance members positioned near the user's feet. A back row, triceps extension and shoulder raises are an examples of exercises that could be performed by a user using the lower base member resistance members.

The resistance level for an exercise with the user standing on the upper base member as in FIGS. 30A and 30B can be easily altered simply by the user standing closer or further from the center of the base. With the user standing closer to the center of the base (flexible), the upper base member and the resistance members threaded through the upper base member will be restricted to a lower position prior to stretching and the resistance member will have to be stretched further to the exercise completion position, like near the shoulders for a bicep curl exercise, and thus there will be more resistance.

There is more resistance stretching the same length resistance member a longer distance than there is stretching the same length resistance member a shorter distance. For example it is harder, more resistance, to stretch a 305 mm (one foot) elastic tube 609 mm (two feet) than to stretch the same length 305 mm (one foot) elastic tube 305 mm (one foot).

Likewise, with the user standing further from the center of the base (flexible), the upper base member and the resistance members threaded through the upper base member will be in a higher position prior to stretching and the resistance member will be stretched a shorter distance to the exercise completion position, like near the shoulders for a bicep curl exercise, and thus there will be less resistance.

There is less resistance stretching the same length resistance member a shorter distance than there is stretching the same length resistance member a longer distance. For example it is easier, less resistance, to stretch a 305 mm (one foot) elastic tube 305 mm (one foot) than to stretch the same length 305 mm (one foot) elastic tube 609 mm (two feet).

The ability to adjust resistance levels, while doing standing exercises, based on where the user stands on the base adds convenience and ease of use for the user and is an advantage over exercise devices of the prior art.

Figure 31A:
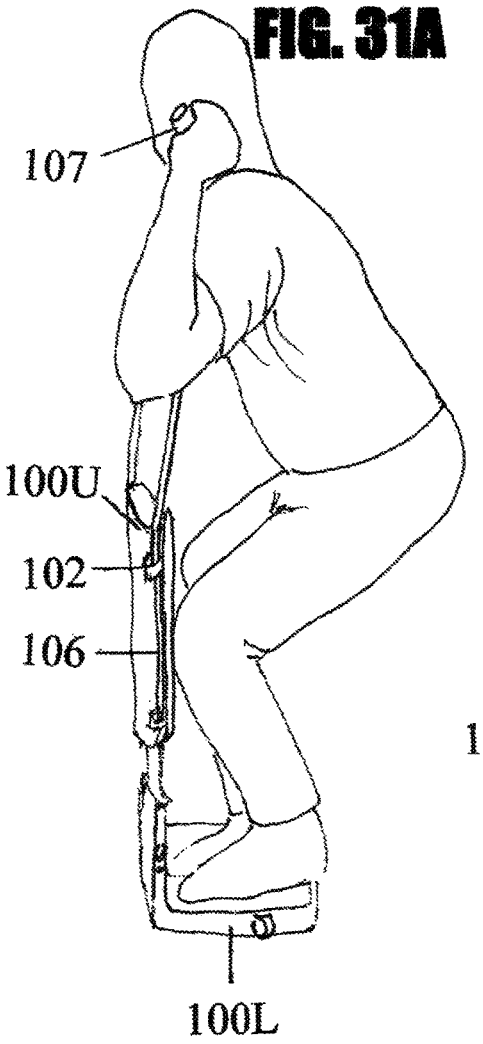
FIGS. 31A-31B are perspective views of a user of the portable exercise device performing a leg squat exercise in a standing position.
Figure 31B:
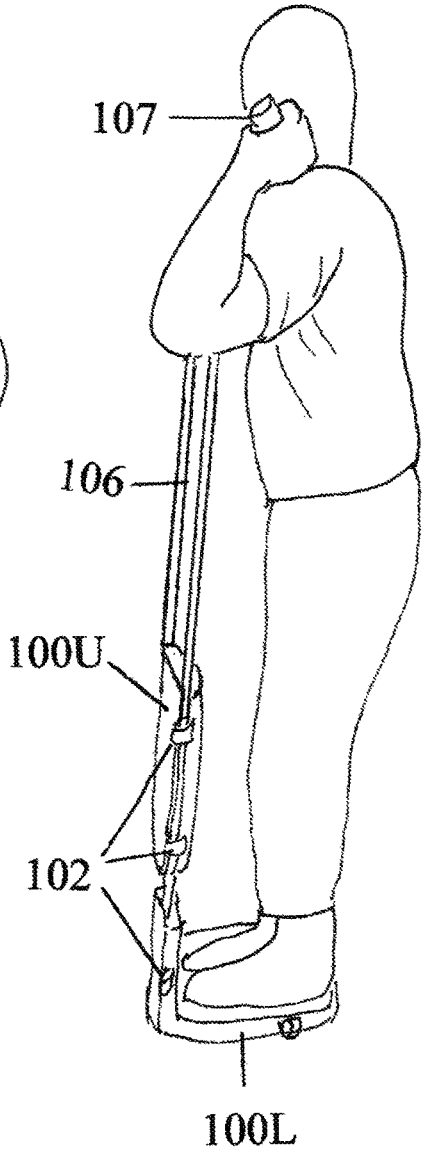

The user in FIGS. 31A and 31B is shown in a standing upright position holding the upper resistance members gripping devices 107 of the upper base member 100U in each hand and standing with feet on the lower base member 100L for stability and comfort of the feet. With the hands near shoulders and the resistance member 106 being partially stretched, the user is bending the knees and lowering the body to a squat position and then returning to a standing upright position stretching the resistance member and exercising the quadriceps leg muscles.

The squat exercise shown in FIGS. 31A and 31B is stretching the resistance members when the user is moving from the squat position upward. The portion of the resistance member being stretched has minimal tension/friction at the base aperture 102 at the top end of the upper base member where the resistance member slides through the base aperture.

The squat exercise shown in FIGS. 31A and 31B shows a standard squat exercise, the resistance during the squat exercise can easily be varied with the user's hands at a lower or higher stationary position or with the user standing further from or closer to the center of the base.

Although the exercise in FIGS. 31A-31B describes a valuable squat quadriceps exercise, there are several other exercises that can be performed for leg muscles which use the portable exercise device while the user is in a similar standing position; a calf raise exercise holding the resistance gripping devices of the upper set of resistance members with arms stationary and having resistance and then further stretch the resistance members while coming up on the user's toes, a lunge exercise holding the resistance gripping devices of the upper set of resistance members with arms stationary and having resistance, stepping forward or backward bending knees and lowering the trailing knee toward the floor, then returning back to standing upright position stretching resistance members and a straight leg deadlift exercise holding the resistance gripping devices of the lower set of resistance members, arms downward, legs locked and bent over from the waist, then stretch resistance members while moving to standing upright position.

Advantages

The new feature of one or more aspects of the portable exercise device not found in the prior art is the use of a plurality of resistance members, threaded through base apertures strategically placed on the device, which when the same resistance members are pulled or pushed at different angles provide different degrees of resistance is an advantage of the portable exercise device.

The additional new feature not found in the prior art, based on the threading of resistance member through base apertures, is the ability to adjust (increase or decrease) the resistance, prior to starting the exercise, by positioning an additional length of the resistance member(s) beyond or behind the base aperture closest to the gripping device is an advantage of the portable exercise device.

The ability to use the resistance members positioned across or against a body part to alter or adjust the resistance for an exercise is an advantage of the exercise device not found (described) with exercises devices of the prior art.

The ability of the user to perform multiple chest, shoulders, back, arms, abdominal and leg exercises using the portable exercise device is an advantage of the portable exercise device.

All the exercises described and others, excluding the described leg exercises, can be performed comfortably with the user seated or lying on the portable exercise device base. The portable exercise device can be used on any seated or lying means without attachment, including but not, limited to a home or office chair, having back or no back; having cushioned or not cushioned; having arms or no arms; a stool; a bench; a sofa; a couch; a wheel chair; a bed or any other structure designed for sitting or lying. The portable exercise device can also be used for many exercises with a portion of the device placed on the floor and the user standing on the floor portion of the device base.

The ability to use the device comfortably on any sitting or lying means as well as in a user standing position is an advantage of the portable exercise device.

Additionally, the portable exercise device has an advantage that the device can be used sitting in a vehicle including but not limited to a car, a truck, a bus, a train, an airplane or any other similar vehicle.

The ability to adjust resistance levels, while doing standing exercises, based on where the user stands on the device/base adds convenience and ease of use for the user and is an advantage over exercise devices of the prior art.

All the exercises described and others can be performed with ease of use and convenience; by the positioned gripping devices of the resistance members ready for any and all exercises, by the ability to easily change resistance levels by attaching or detaching resistance members to the resistance member gripping devices (and with the resistance members having different resistance levels), by the ease of adjusting the resistance of the resistance members, by the ability of the user to stay in the same position (sitting, lying or standing) for all exercises, by the flexibility and options of the exercises using resistance members verses free weights and by the ability to use the portable exercise device on any sitting or lying means, or in a standing position.

The ease of use and convenience of the portable exercise device is an advantage of the portable exercise device.

Also with the portable exercise device's ease of use; the positioned gripping devices ready for any and all exercises, the ability to easily change resistance levels and the ability of the user to stay in the same sitting, lying or standing position for all exercises, the time for the user to complete a workout is minimized and often can be less than five minutes.

The minimized time for the user to complete a workout using the portable exercise device is an advantage of the portable exercise device.

By the ability to use the portable exercise device comfortably on any sitting or lying means, as well as in a standing position, for a variety of exercises and to be able to perform the exercises with one or two hands, the portable exercise device can be a valuable tool for physical therapy.

The ability to use the portable exercise device for physical therapy is an advantage of the portable exercise device.

Many embodiments and aspects of the portable exercise device can be manufactured with common, well known, readily available and inexpensive parts like resistance tube sets, seat chair cushions and webbing straps (which can form the base apertures) and without any additional mechanical or metal parts. Thus the complexity, time and cost required to manufacture the portable exercise device is minimized.

The ability to manufacture the portable exercise device with minimal parts, complexity, time and cost is an advantage of the portable exercise device.

In addition the portable exercise device has the advantage of being light weight.

CONCLUSION, RAMIFICATIONS AND SCOPE

The detailed description of portable exercise device includes several embodiments; a base with upper and lower base members with at least one resistance member threaded through base apertures (FIGS. 1-3), a one piece base with at least one resistance member threaded through outward base apertures (FIGS. 4A-4B), a one piece base with a plurality of resistance members threaded through inward base apertures (FIGS. 5A-5B), a one piece base with one set of at least one resistance member threaded through base apertures (FIGS. 7A-7B), a base with upper and lower base members with a plurality of resistance members with one end attached to the base apertures and the other end threaded through base apertures (FIG. 8) and an upper and lower base members with at least one resistance member that can be rotated between the base apertures of the upper and lower base members (FIGS. 9A-9B).

It can be seen that the portable exercise device can be used comfortably and conveniently by a user to perform many chest, shoulders, back, arms, abdominal and leg exercises.

And with the portable exercise device's advantages of being usable on any sitting or lying means, that the resistance of the exercises can be different based on the angle the resistance member is extended, the ease of adjusting resistance and general ease of use, the possible reduced time for a workout with the device, the ability to use the device for physical therapy and the ability to manufacture and sell the device affordably, the value of the portable exercise device is evident.

With the portable exercise device's comfort, convenience, exercise options and advantages, users will have an increased chance of exercising and continuing to exercise and therefore improving their health and fitness.

It is to be understood that this detailed description of the portable exercise device and the device's operation (exercises using the portable exercise device) while exemplary and explanatory, are not restrictive of the device.

The invention claimed is:

1. A portable exercise device configured to be positioned underfoot of the user while the user performs standing leg and upper body resistance exercises or between a selected portion of the body of the user and any structure designed for sitting or lying while the user performs seated or lying upper body resistance exercises, the portable exercise device comprising:

a. a base having a flexible body from which two sets of base apertures extend outwardly from respective peripheral edges of said body, each set of said base apertures located on a respective half of said body and include a combination of base hook apertures, base "O" ring apertures, base "D" ring apertures, base strap apertures and/or upper and lower base member attachment apertures; and b. at least one resistance member threaded through each set of said base apertures of said base such that each end of each said resistance member is free and available for gripping by the user with neither end nor any portion of said resistance member directly fastened or anchored to said base, wherein said base apertures are configured to be arranged such that each of said at least one resistance members threaded through the said base apertures is configured to be stretched by the user at different angles beyond said base apertures to create different degrees of resistances for different exercises.

2. The portable exercise device for resistance exercises of claim 1, wherein said at least one resistance member having a resistance member gripping device at each end.

3. The portable exercise device for resistance exercises of claim 1 wherein said base can be rolled or folded by the user for ease of carrying, storage and insertion into a carrying case.

4. The portable exercise device for resistance exercises of claim 1, wherein said base is flexible and said base includes a padded region providing for improved comfort of the user while performing the resistance exercises.

5. The portable exercise device for resistance exercises of claim 1, wherein said base being symmetrically configured about a generally central axis, said base comprising an upper base member and a lower base member, said upper base member and said lower base member attached by an upper and lower base member attachment or an upper or lower base member attachment aperture.

6. The portable exercise device for resistance exercises of claim 5, wherein said upper base member and said lower base member includes cushions of a durable material covering a foam or rubber interior.

7. The portable exercise device for resistance exercises of claim 6, wherein said lower base member having surface dimensions sufficient to extend at least substantially over the entire buttock area of the user to provide firm and immovable contact of said base, and said upper base member to be positioned behind the back of the user.

8. The portable exercise device for resistance exercises of claim 1, wherein said at least one resistance member a resistance member gripping device at each end, said base is flexible and said base includes a padded region providing for improved comfort of the user while performing the resistance exercises.

9. A portable exercise device configured to be positioned underfoot of the user while the user performs standing leg and upper body exercises or between a selected portion of the body of the user and any means for sitting or lying while the user performs seated or lying upper body exercises for resistance exercises, the portable exercise device comprising:

an upper base member and a lower base member connected to each other, each base member further comprising:

first and second base aperture straps defining a first set of base apertures attached to respective corners of each base member proximal to the connection of the upper and lower base member, and third and fourth base aperture straps defining a second set of base apertures attached to respective corners of each base member distal to the connection of the upper and lower base member, at least one resistance member threaded through each set of said base apertures of each of the upper and lower base member such that each free end of each resistance member is available for gripping by the user with neither end nor any portion of each resistance member directly fastened or anchored to a respective one of said upper and lower base members, wherein said base apertures are configured to be arranged such that said resistance members threaded through said base apertures are configured to be stretched by the user at different angles beyond said base apertures to create different degrees of resistance for different exercises.

10. The portable exercise device for resistance exercises of claim 9, wherein said at least one resistance member having a resistance member gripping device at each end.

11. The portable exercise device for resistance exercises of claim 9 wherein said upper and lower base members can be rolled or folded by the user for ease of carrying, storage and insertion into a carrying case.

12. The portable exercise device for resistance exercises of claim 9, wherein said upper and lower base members are flexible and said upper and lower base members each include a padded region providing for improved comfort of the user while performing the resistance exercises.

13. The portable exercise device for resistance exercises of claim 9, wherein said upper and lower base members are symmetrically configured about a generally central axis, said upper base member and said lower base member attached by an upper and lower base member attachment or an upper or lower base member attachment aperture.

14. The portable exercise device for resistance exercises of cairn 13, wherein said upper base member and said lower base member include cushions of a durable material covering a foam or rubber interior.

15. The portable exercise device for resistance exercises of claim 14, wherein said lower base member having surface dimensions sufficient to extend at least substantially over the entire buttock area of the user to provide firm and immovable contact of said base, and said upper base member to be positioned behind the back of the user.

16. The portable exercise device for resistance exercises of claim 9, wherein said at least one resistance member having a resistance member gripping device at each end, said upper and lower base members are flexible and said upper and lower base members each include a padded region providing for improved comfort of the user while performing the resistance exercises.

* * * * *